US010405731B2

(12) United States Patent
Harr

(10) Patent No.: US 10,405,731 B2
(45) Date of Patent: Sep. 10, 2019

(54) SPECIALTY DISHWASHER FOR GLASSES AND LOWER RACK FOR SAME

(71) Applicants: BSH Home Appliances Corporation, Irvine, CA (US); BSH Hausgeräte GmbH, Munich (DE)

(72) Inventor: Deborah Harr, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 3 days.

(21) Appl. No.: 15/697,479

(22) Filed: Sep. 7, 2017

(65) Prior Publication Data

US 2019/0069756 A1 Mar. 7, 2019

(51) Int. Cl.
*A47L 15/50* (2006.01)
*A47L 15/00* (2006.01)

(52) U.S. Cl.
CPC ..... *A47L 15/505* (2013.01); *A47L 15/502* (2013.01); *A47L 15/503* (2013.01); *A47L 15/0065* (2013.01)

(58) Field of Classification Search
CPC ..... A47L 15/503; A47L 15/505; A47L 15/50; A47L 15/502; A47L 15/504; A47L 15/506; A47L 15/507; A47L 2301/06; A47L 15/0065; A47L 15/501
USPC ..... 211/41.8, 41.3, 41.4, 41.5; 134/135
See application file for complete search history.

(56) References Cited

U.S. PATENT DOCUMENTS 3,612,285 A * 10/1971 Mason ..... A47L 15/503 211/41.8
3,752,322 A * 8/1973 Fiocca ..... A47L 15/503 211/41.8
4,046,261 A * 9/1977 Yake ..... A47L 15/503 211/184
5,205,419 A * 4/1993 Purtilo ..... A47L 15/503 134/200
5,649,630 A * 7/1997 Remmler ..... A47L 15/503 134/135
6,571,965 B1 * 6/2003 Beck ..... A47L 15/503 211/41.8
7,228,975 B2 * 6/2007 Yang ..... A47L 19/04 211/41.4
7,766,175 B2 * 8/2010 Jadhav ..... A47L 15/505 211/41.9
7,931,155 B2 * 4/2011 Bastuji ..... A47L 15/503 134/56 D (Continued)

FOREIGN PATENT DOCUMENTS

DE 1441025 A1 5/1996
DE 29711822 U1 10/1998

(Continued)

*Primary Examiner* — Hiwot E Tefera
(74) *Attorney, Agent, or Firm* — Michael E. Tschupp; Andre Pallapies; Brandon G. Braun

(57) ABSTRACT

A dishwasher, including: a dishwashing compartment having a loading opening; a door configured to close the loading opening; and at least one washware rack configured for movement out of and into the dishwashing compartment, wherein the at least one washware rack includes a frame having a bottom portion and a side wall portion; and at least one adjustable glass support member extending across an interior of the at least one washware rack and disposed on the frame via brackets.

23 Claims, 18 Drawing Sheets

(56) References Cited

U.S. PATENT DOCUMENTS

| | | | | |
|---|---|---|---|---|
| 9,119,524 | B2 * | 9/2015 | Renz | A47L 15/505 |
| 9,131,828 | B2 | 9/2015 | Yoon et al. | |
| 9,414,737 | B2 * | 8/2016 | Paschini | A47L 15/502 |
| 2005/0242046 | A1 * | 11/2005 | Lee | A47L 15/503 211/41.9 |
| 2006/0254992 | A1 * | 11/2006 | Lim | A47L 15/505 211/41.9 |
| 2006/0254994 | A1 * | 11/2006 | Lim | A47L 15/505 211/41.9 |
| 2007/0039904 | A1 * | 2/2007 | Purushothaman | A47L 15/503 211/41.8 |
| 2007/0131696 | A1 * | 6/2007 | Schessl | A47L 15/503 220/489 |
| 2007/0199584 | A1 * | 8/2007 | Koch | A47L 15/503 134/135 |
| 2012/0292273 | A1 * | 11/2012 | Mcnamara | A47L 15/503 211/79 |
| 2014/0174486 | A1 * | 6/2014 | Fey | A47L 15/503 134/135 |
| 2015/0327749 | A1 * | 11/2015 | Kaberg | A47L 15/502 211/41.9 |
| 2016/0037997 | A1 * | 2/2016 | Mesa | A47L 15/503 134/166 R |

FOREIGN PATENT DOCUMENTS

| | | | | |
|---|---|---|---|---|
| DE | 29822086 | U1 | 6/1999 | |
| DE | 10353725 | A1 | 6/2005 | |
| DE | 102006055346 | A1 | 5/2008 | |
| EP | 1356761 | A2 | 10/2003 | |
| EP | 2074925 | A1 * | 7/2009 | A47L 15/503 |
| EP | 2798996 | A1 | 11/2014 | |

* cited by examiner

SPECIALTY DISHWASHER FOR GLASSES AND LOWER RACK FOR SAME

FIELD OF THE INVENTION

The present disclosure relates generally to dishwasher appliances and to racks for holding dishware and glassware for a dishwasher. More particularly, the present disclosure relates to a specialty dishwasher for cleaning glasses and to a lower washware rack for the specialty dishwasher. The lower washware rack is configured to hold primarily glasses, and particularly stemware and barware type glasses.

BACKGROUND OF THE INVENTION

In general, most domestic dishwashers include two dishware racks to support items to be washed such as dishware, glassware, kitchen utensils, pots, pans, and the like. Typically, the two dishware racks include an upper dishware rack positioned near a top portion of the dishwasher, and a lower dishware rack arranged below the upper dishware rack. The upper dishware rack is used to support glassware, utensils, and other small items, while the lower dishware rack is used to support larger items, such as dinner plates, large bowls, cooking sheets, and baking pans. The dishware racks are normally formed from several discrete lengths of wire, welded together and then covered with a rubber or a plastic coating. Further, the dishware racks are formed with a plurality of vertically projecting tines to support and organize the items placed on the dishware rack.

Domestic or residential dishwashers and basket or washware rack systems are currently designed as general purpose units for handling entire table place settings. For example, the lower dishware rack or basket is designed to hold primarily plates, bowls, pots, pans, etc.

SUMMARY OF THE INVENTION

However, the current lower washware racks are not well suited for holding glasses, and particularly stemware and barware type glasses. For example, the current lower washware racks have a plurality of vertically projecting tines that make it cumbersome and difficult to support stemware and barware type glasses.

An apparatus consistent with the present disclosure is directed to a specialty dishwasher that is configured to clean glasses. For example, the specialty dishwasher could be a residential user's second unit intended primarily for cleaning glassware.

An apparatus consistent with the present disclosure provides a specialty dishwasher whose capacity is increased for glasses. Thus, users can fill the entire dishwasher unit with glasses. Moreover, a large number of stemware can be supported.

An apparatus consistent with the present disclosure is directed to a lower washware rack for the specialty dishwasher, the lower washware rack being configured to hold primarily glasses, and particularly stemware and barware type glasses. Also, the lower washware rack is flexible to support different sizes and shapes of glasses.

According to one aspect, the present disclosure provides a dishwasher, comprising: a dishwashing compartment having a loading opening; a door configured to close the loading opening; and at least one washware rack configured for movement out of and into the dishwashing compartment, wherein the at least one washware rack comprises: a frame having a bottom portion and a side wall portion; and at least one adjustable glass support member extending across an interior of the at least one washware rack and disposed on the frame via brackets.

According to another aspect, the at least one washware rack comprises a lower washware rack.

According to another aspect, the lower washware rack is devoid of any vertical tines extending from the bottom portion of the frame.

According to another aspect, the at least one adjustable glass support member is adjustable between a use position where glasses can rest against the at least one adjustable glass support member, and a non-use position where the at least one adjustable glass support member is swung down out of the way to the bottom portion of the frame.

According to another aspect, the at least one adjustable glass support member comprises an adjustable wavy glass support wire.

According to another aspect, the at least one adjustable wavy glass support wire has a pattern of recesses that are spaced so as to allow glasses having different diameters to load efficiently on condition that the at least one adjustable glass support member is in the use position.

According to another aspect, on condition that the at least one adjustable glass support member is in a non-use position, the bottom portion of the frame is configured to hold larger items including at least one of punch bowls, pots, pans, bowls, plates, or cooking sheets.

According to another aspect, the at least one adjustable glass support member comprises a plurality of adjustable wavy glass support wires.

According to another aspect, the brackets are configured to allow height adjustment of the at least one adjustable glass support member.

According to another aspect, the brackets are disposed on opposing side walls of the frame and are configured to allow height adjustment of the at least one adjustable glass support member.

According to another aspect, the brackets are disposed on opposing side walls of the frame, and wherein each bracket includes an elongated substantially vertical slot for an end portion of the at least one adjustable glass support member to move up and down in, and a plurality of substantially vertically spaced stepped portions arranged alongside of the elongated substantially vertical slot for receiving an end of the at least one adjustable glass support member to adjust the height of the at least one adjustable glass support member.

According to another aspect, each of the stepped portions comprises a curved opening.

According to another aspect, each of the stepped portions comprises a substantially horizontal plate-shaped member.

According to another aspect, each of the stepped portions comprises a saw-toothed shaped member.

According to another aspect, the brackets are disposed on opposing side walls of the frame, and wherein each bracket includes a generally J-shaped elongated slot for an end portion of the at least one adjustable glass support member to move in, and a plurality of substantially vertically spaced slots arranged adjacent to the generally J-shaped elongated slot for receiving the end portion of the at least one adjustable glass support member to adjust the height of the at least one adjustable glass support member.

According to another aspect, in the dishwasher, the at least one washware rack comprises an insert member which is disposed in the bottom portion of the frame.

According to another aspect, the insert member comprises a grill configured to hold a plurality of glasses at an angle.

According to another aspect, the grill comprises a plurality of plate members mounted on a frame of spaced apart, substantially perpendicular crossbars.

According to another aspect, the grill comprises a plurality of angled stepped portions.

According to another aspect, the insert member comprises a plurality of tabs and snaps to retain the insert member in the bottom portion of the frame of the at least one washware rack.

According to another aspect, the present disclosure provides a washware rack assembly for a dishwasher configured to receive washware including glassware therein and to be inserted into and removed from a dishwashing compartment of the dishwasher, the washware rack assembly comprising: a frame having a bottom portion and a side wall portion; and at least one adjustable glass support member extending across an interior of the washware rack assembly and disposed on the frame via brackets.

According to another aspect, the washware rack assembly comprises a lower washware rack.

According to another aspect, the lower washware rack is devoid of any vertical tines extending from the bottom portion of the frame.

According to another aspect, the washware rack assembly further comprises an insert member which is disposed in the bottom portion of the frame.

According to another aspect, in the washware rack assembly, the at least one adjustable glass support member comprises an adjustable wavy glass support wire.

According to another aspect, the present disclosure provides a dishwasher, comprising: a dishwashing compartment having a loading opening; a door configured to close the loading opening; and at least one washware rack configured for movement out of and into the dishwashing compartment, wherein the at least one washware rack comprises: a frame having a bottom portion and a side wall portion; an insert member which is disposed in the bottom portion of the frame; and at least one height adjustable wavy glass support wire extending across an interior of the at least one washware rack and disposed on the frame via brackets.

According to another aspect, the insert member comprises a grill configured to hold a plurality of glasses at an angle.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 4A:
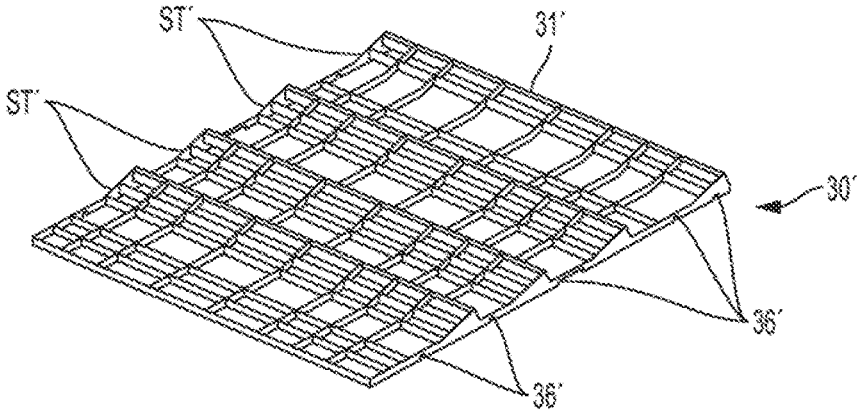
Figure 4B:
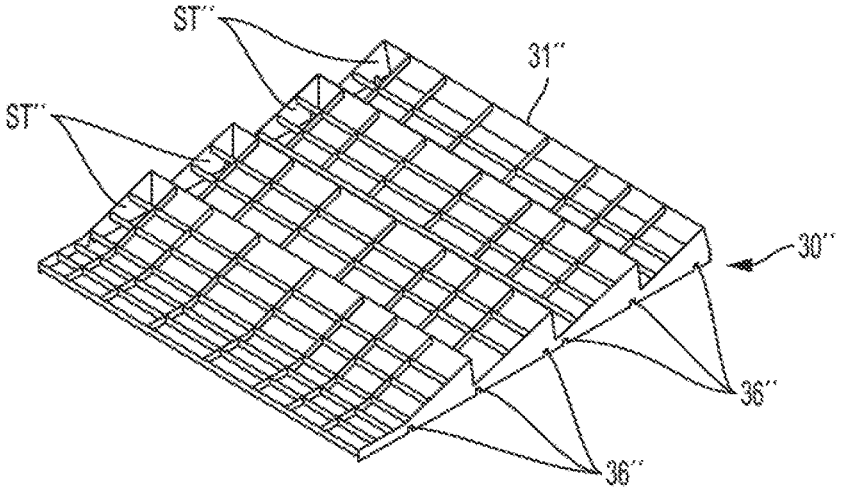
Figure 4C:
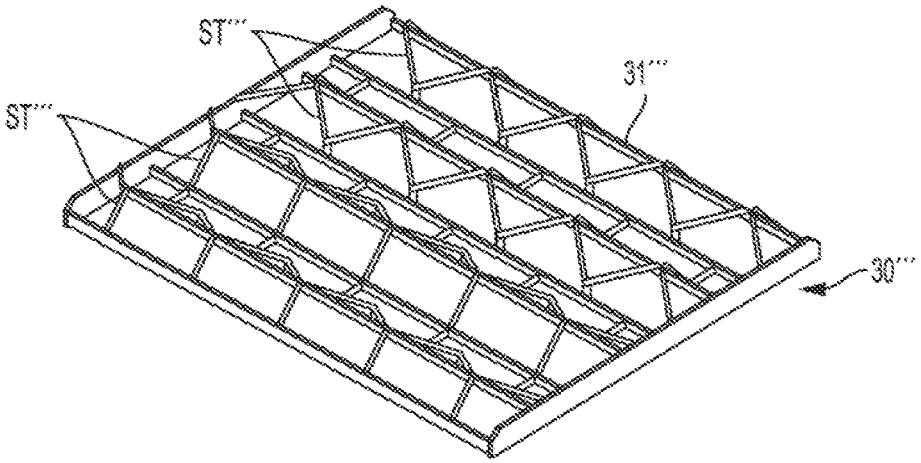
Figure 5A:
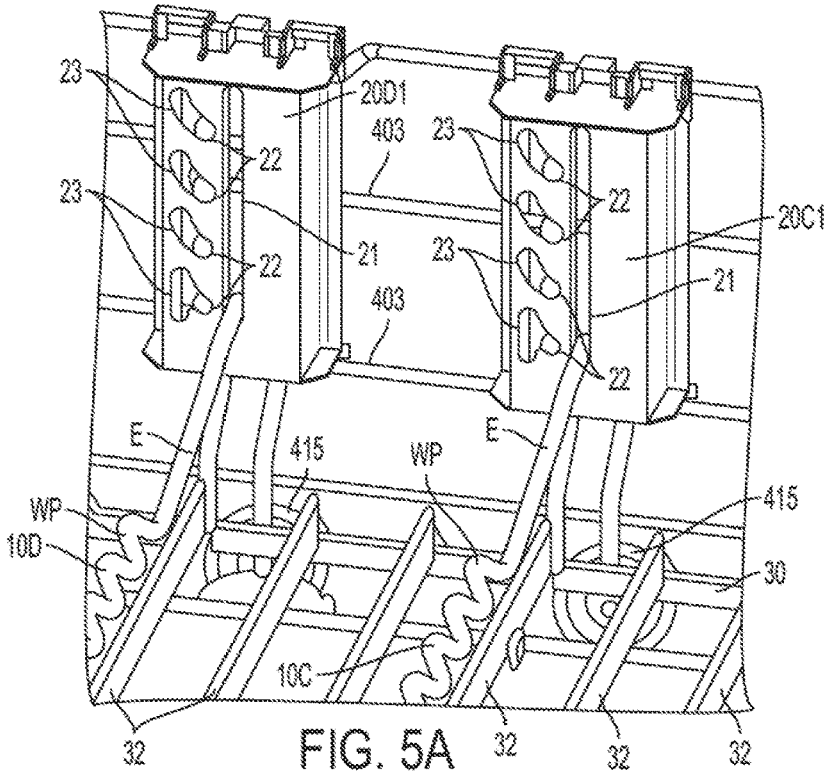
Figure 5B:
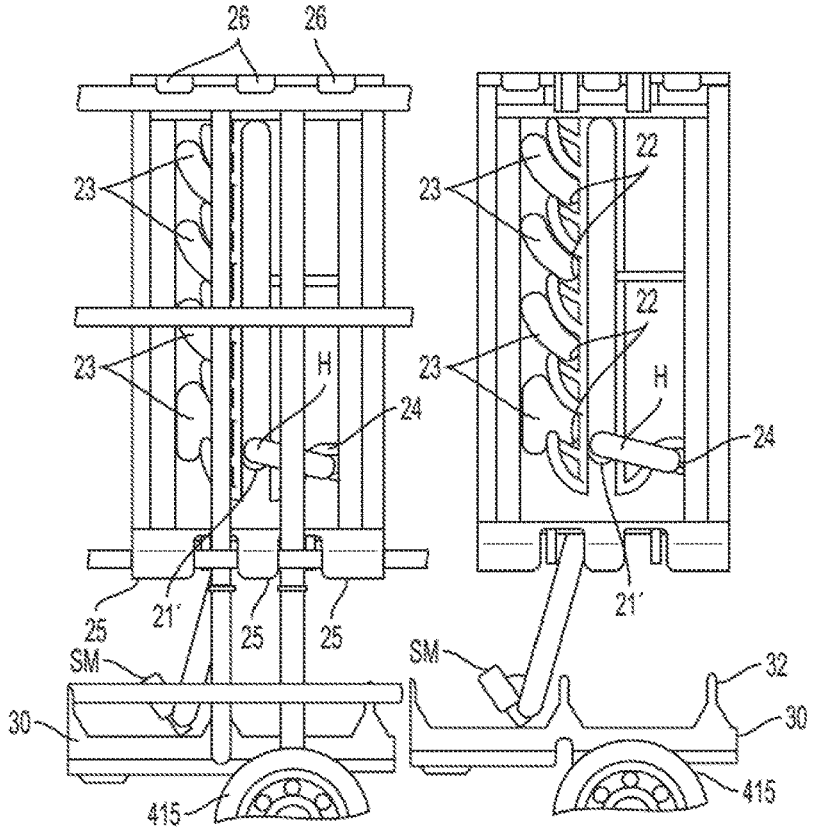
Figure 6A:
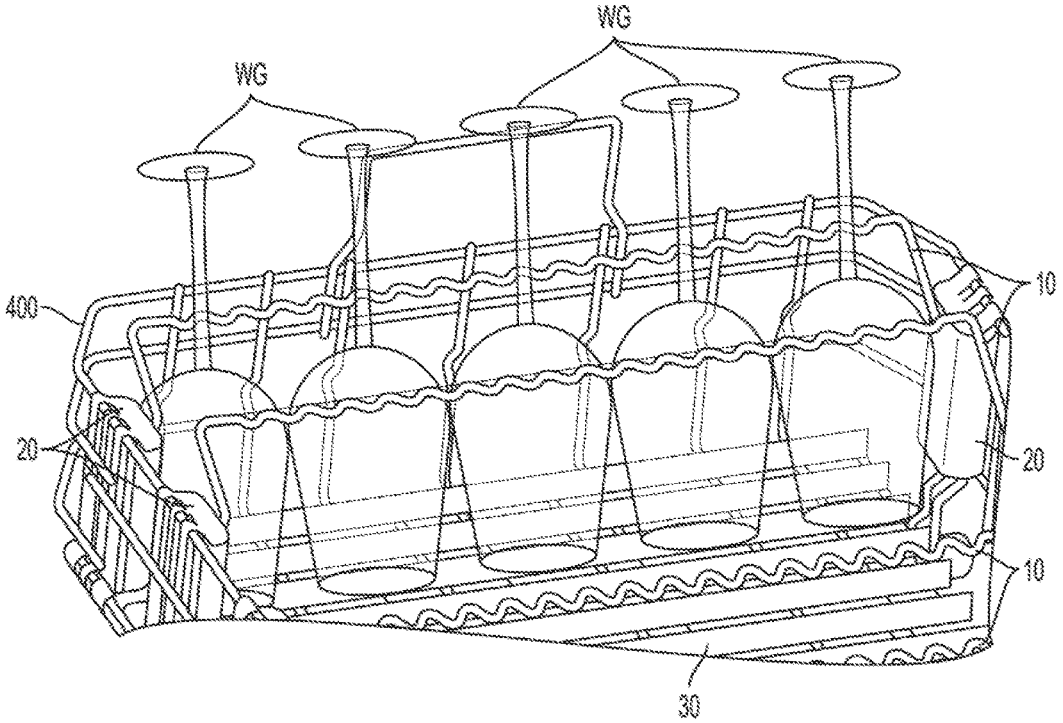
Figure 6B:
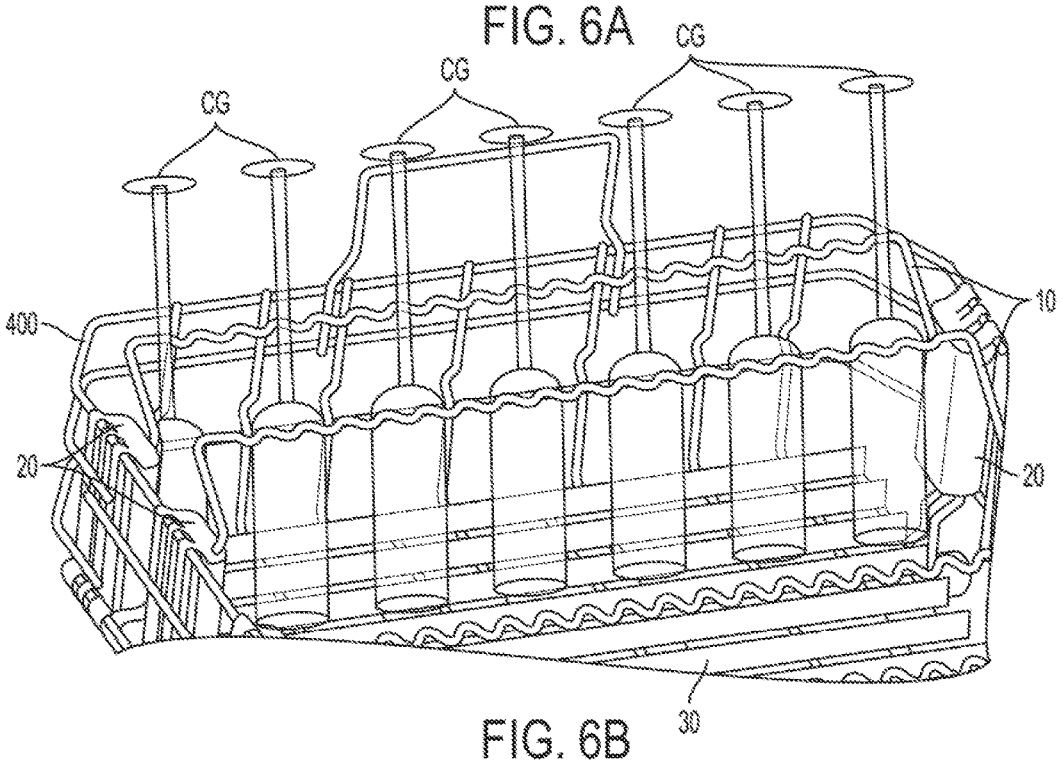
Figure 6C:
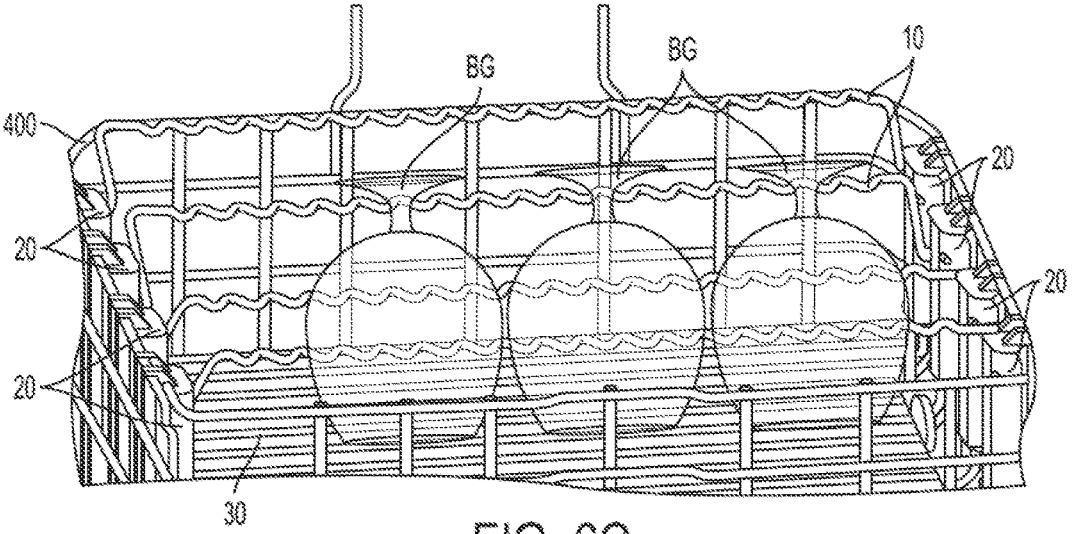
Figure 7A:
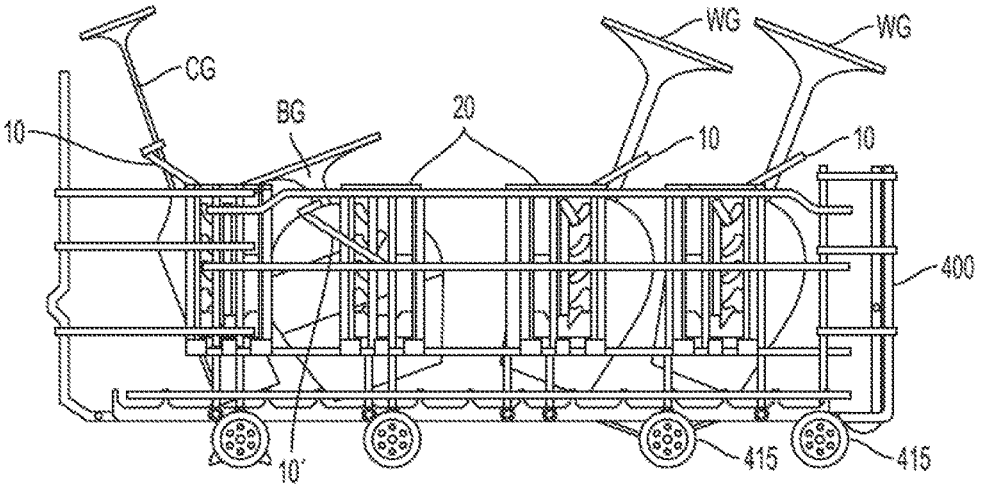
Figure 7B:
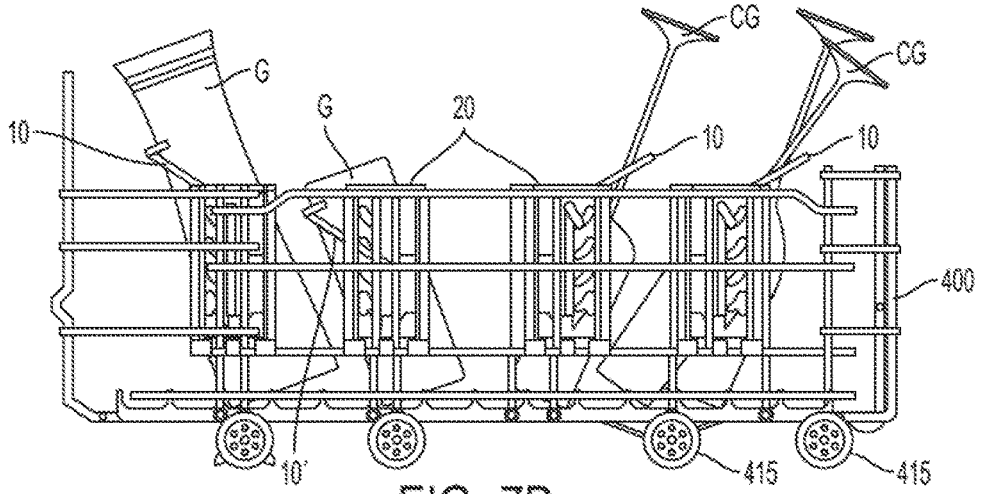
Figure 8A:
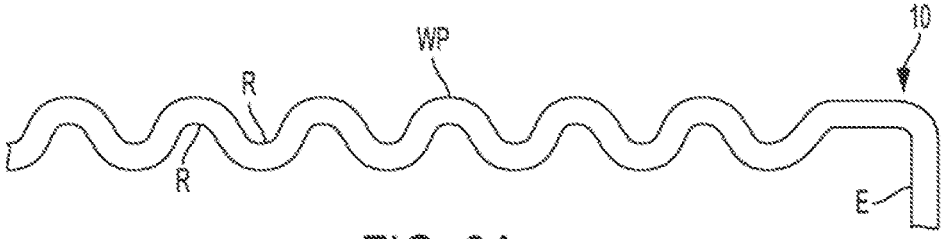
Figure 10A:
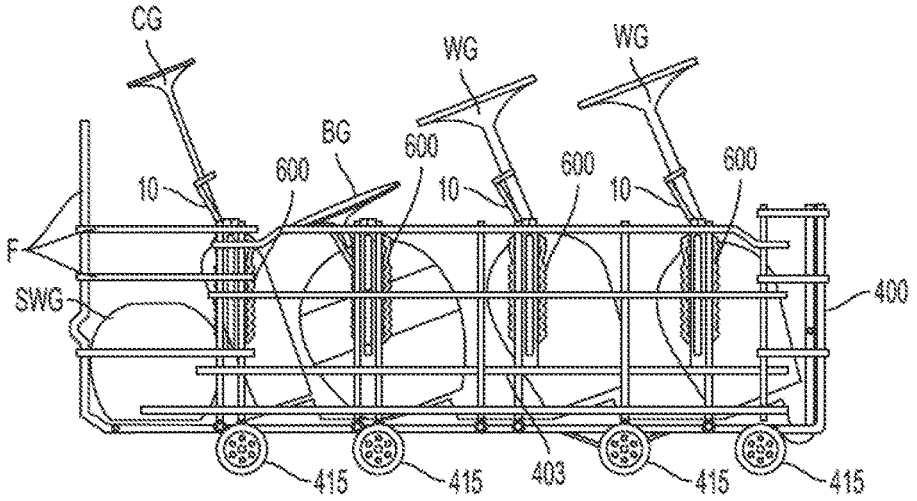
Figure 10B:
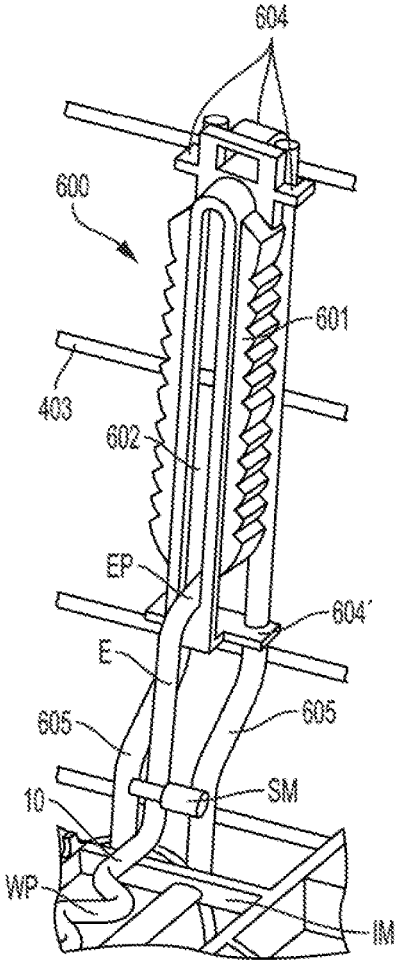
Figure 10C:
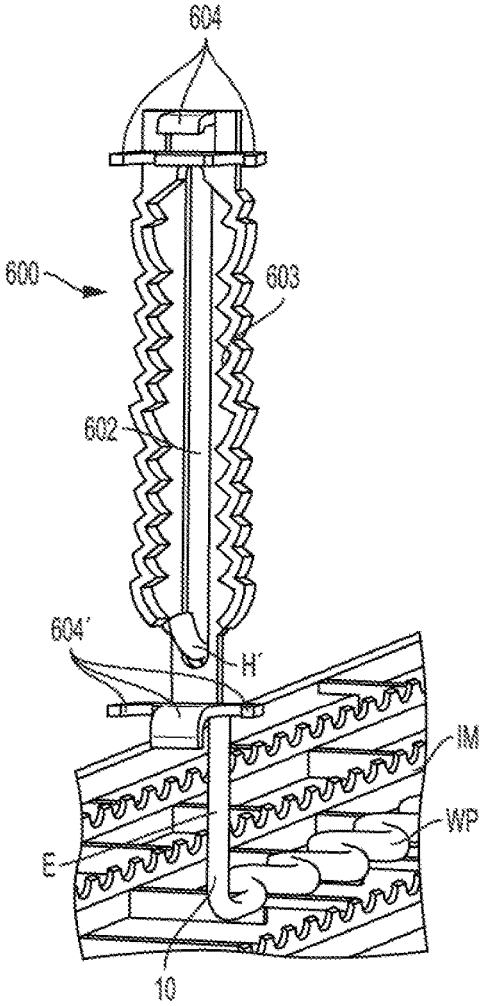
Figure 10E:
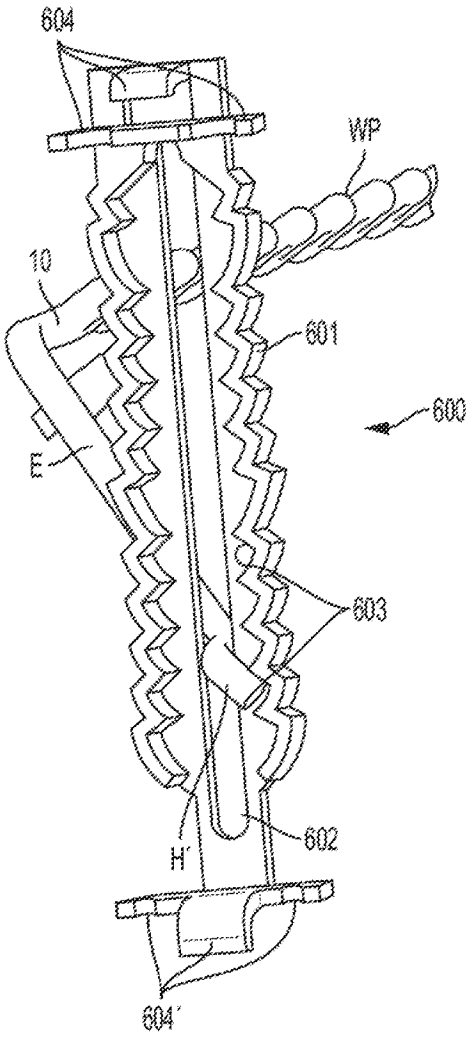
Figure 10D:
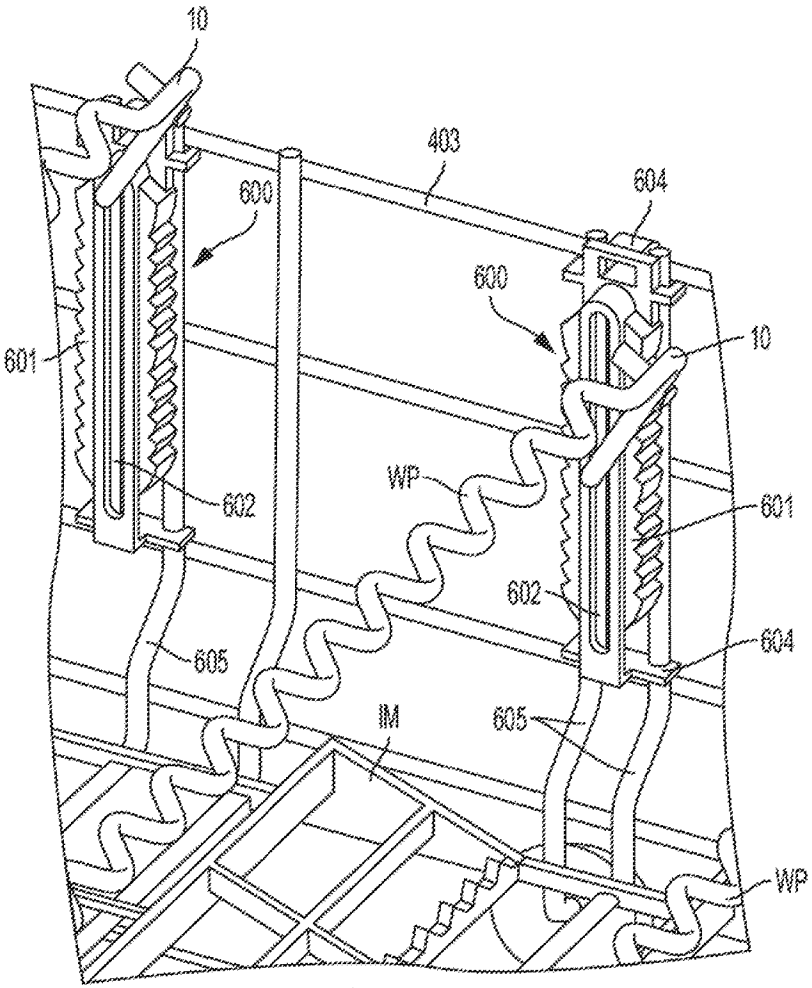
Figure 11A:
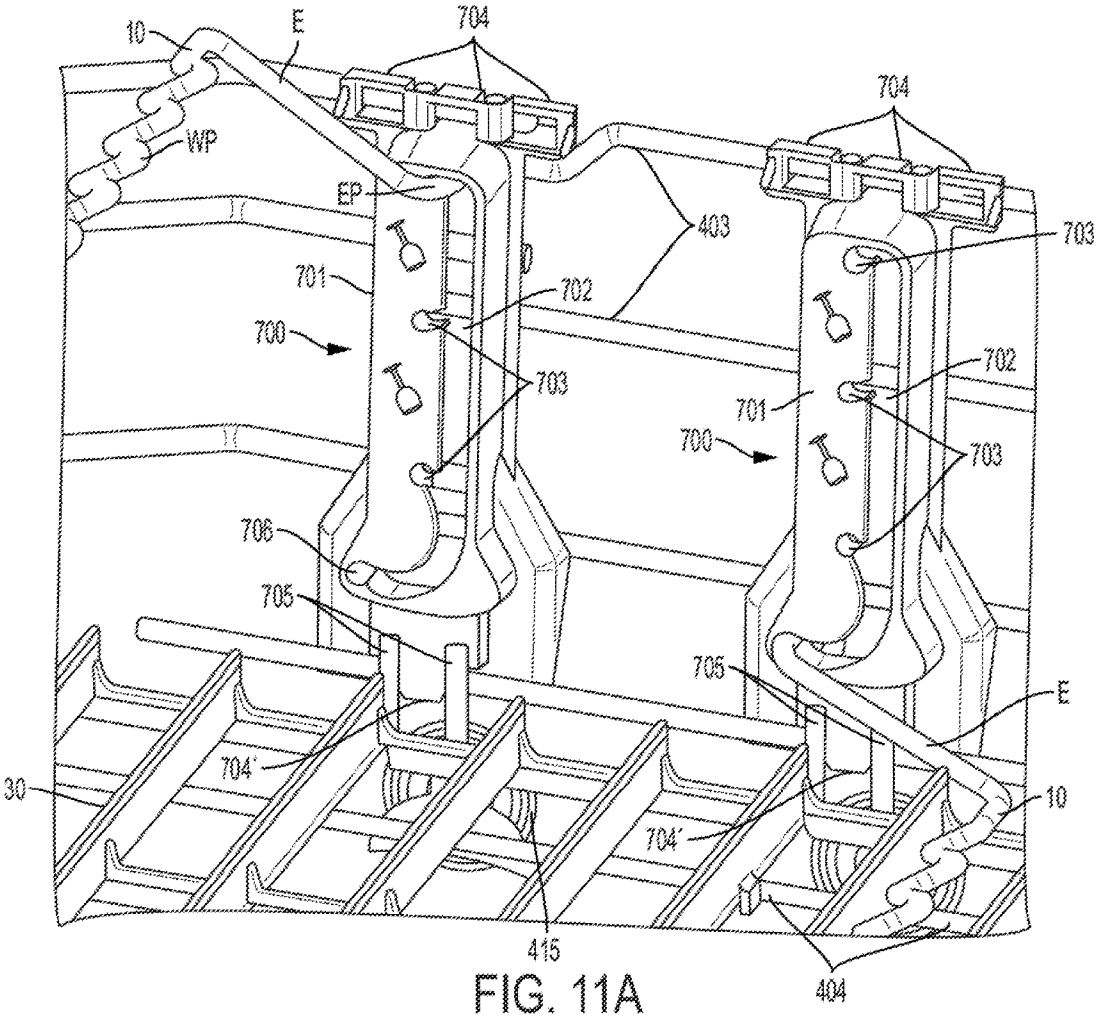
Figure 11C:
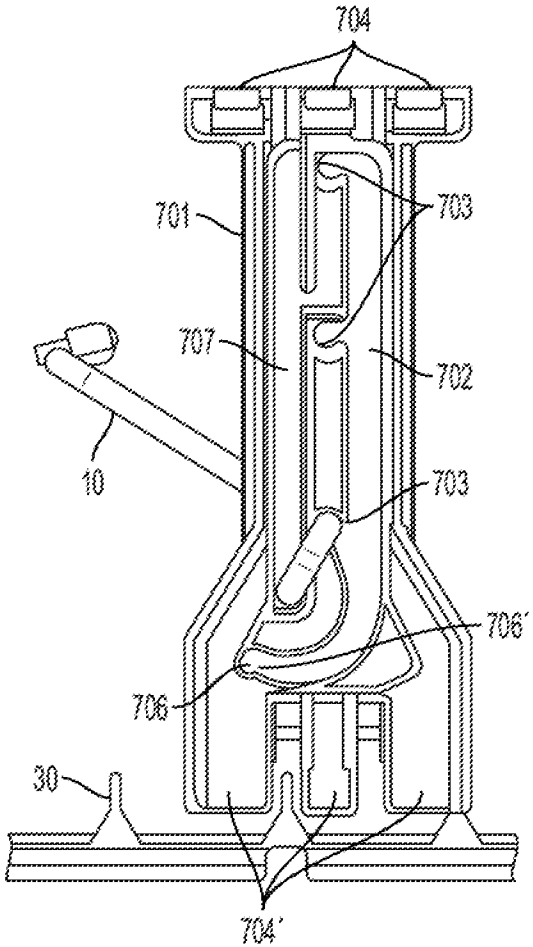
Figure 11B:
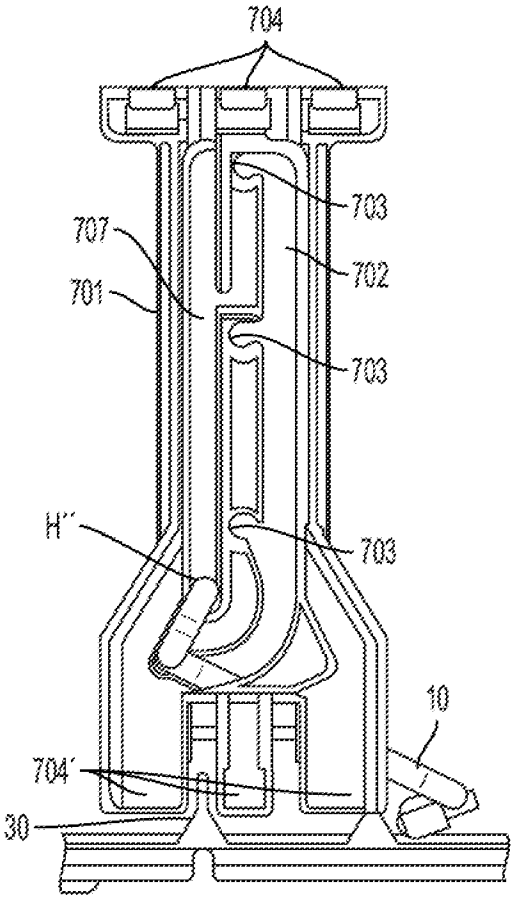

FIGS. 4A, 4B, and 4C are top perspective views of various alternative embodiments of the insert member that is disposed on the bottom portion of the lower washware rack according to an exemplary embodiment consistent with present disclosure;

FIGS. 5A and 5B show enlarged views of the support brackets (or brackets) for supporting the adjustable wavy glass support wires starting in a lowered, non-use position according to an exemplary embodiment consistent with present disclosure;

FIGS. 5C, 5D, 5E, and 5F are enlarged views of the support brackets for supporting the adjustable wavy glass support wires showing the wavy glass supporting wire being adjusted upwardly from the lowest position to the highest position according to an exemplary embodiment consistent with present disclosure;

FIGS. 6A, 6B, and 6C are partial, top perspective views showing wine glasses, champagne glasses, and brandy glasses, respectively, being supported by the adjustable wavy glass support wires in the lower washware rack according to an exemplary embodiment consistent with present disclosure;

FIGS. 7A and 7B are side elevation views of the lower washware rack with various types of glasses being supported by the adjustable wavy glass support wires according to an exemplary embodiment consistent with present disclosure;

FIG. 8A is a fragmentary, enlarged view of one of the adjustable wavy glass support wires according to an exemplary embodiment consistent with present disclosure;

FIGS. 8B, 8C, 8D, and 8E are views of various additional embodiments of one of the adjustable glass support members consistent with present disclosure;

FIGS. 9A, 9B, 9C, and 9D are various views of a further embodiment of the support brackets for supporting the adjustable wavy glass support wires in the lower washware basket according to an exemplary embodiment consistent with present disclosure;

FIG. 10A is a side elevation view of a still further embodiment of the support brackets for supporting the adjustable wavy glass support wires in the lower washware basket according to an exemplary embodiment consistent with present disclosure;

FIG. 10B shows an enlarged view of the support bracket of FIG. 10A for supporting the adjustable wavy glass support wires starting in a lowered, non-use position according to an exemplary embodiment consistent with present disclosure;

FIGS. 10C, 10D, and 10E are enlarged views of the support bracket of FIG. 10A for supporting the adjustable wavy glass support wires showing the adjustable wavy glass supporting wire being adjusted upwardly to a desired position according to an exemplary embodiment consistent with present disclosure; and FIG. 11A is a fragmentary perspective view from inside the lower washware rack and FIGS. 11B and 11C are side elevation views from outside the lower washware rack of a still further embodiment of the support brackets for supporting the adjustable wavy glass support wires in the lower washware rack according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, upper, lower, upward, downward, and the like used herein are for orientation purposes with respect to the drawings when describing the exemplary embodiments and should not limit the present invention. Further, terms such as right, left, right side, left side used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

Figure 1:
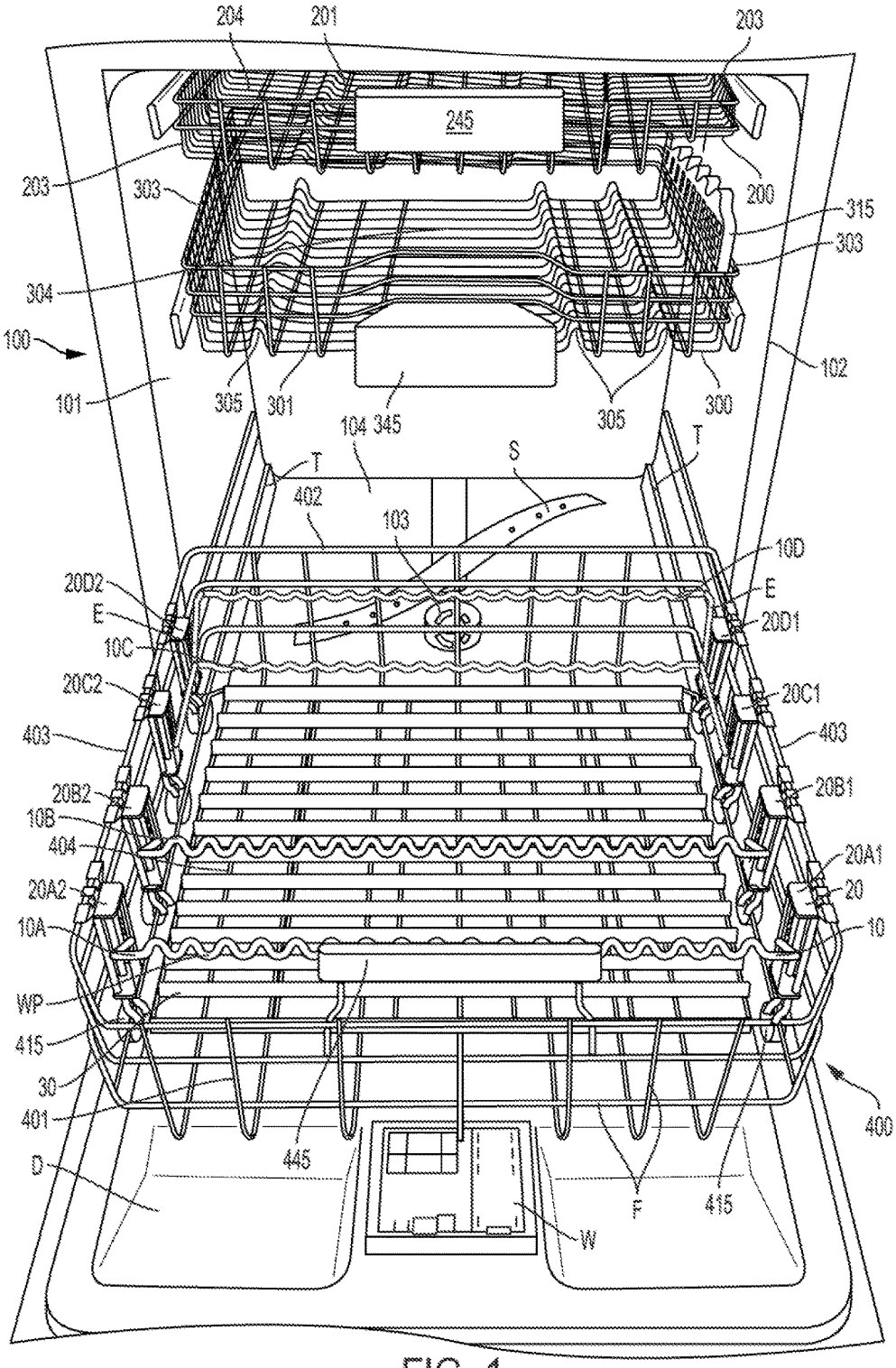
FIG. 1 is a front perspective view of a specialty dishwasher appliance according to an exemplary embodiment consistent with present disclosure, with the door open so as to reveal the dishwashing compartment including a lower washware rack.

FIG. 1 is a front perspective view of a specialty dishwasher appliance 100 according to an exemplary embodiment consistent with present disclosure, with the door D open so as to reveal the dishwashing compartment 101 having a loading opening 102 and including a third, top washware rack 200 that is positioned immediately above a second or middle washware rack 300. The middle washware rack 300 is in turn positioned above a first, bottom or lower washware rack 400.

As shown in FIG. 1, the dishwasher appliance 100 includes a rotating sprayer arm S, and a drain 103 in a tub 104. The door D includes a washing agent dispenser W. Also, although not shown, as is known in the art, the dishwasher appliance 100 includes a pump and filter assembly, a heating element, additional sprayer or wash arms, and a drain hose. A detailed description of the suitable structure and operation of the dishwasher appliance 100 does not form part of the present disclosure, but can be found, for example, in U.S. Pat. Nos. 9,445,703 and 9,510,729 which are incorporated herein by reference.

More specifically, the first, bottom or lower washware rack 400 is normally configured as a basket for holding larger plates, large bowls, pans, cookware such as a cooking sheet, etc. The bottom or lower washware rack 400 is configured as a frame F that includes a sidewall portion including front 401, rear 402, and opposing side walls 403 interconnected with a bottom portion 404 and formed by a plurality of wire shaped elements. The bottom or lower washware rack 400 normally includes a plurality of vertically extending tines or tine members; however, the bottom washware rack 400 is devoid of any such tines according to an exemplary embodiment consistent with present disclosure. At the bottom portion of the bottom or lower washware rack 400 at the left and right sides thereof, rollers 415 are provided and are configured to run on corresponding flanges or tracks T on the inside wall of the dishwashing compartment 101 and also on an inside surface of the door D, as is conventional in the art. The bottom washware rack 400 can include a handle 445.

The second or middle washware rack 300 is positioned immediately above the bottom washware rack 400. The middle washware rack 300 is configured as a basket to hold medium sized dishes, bowls such as medium sized bowls, and glasses. The middle washware rack 300 includes front 301, rear (not shown), and opposing side walls 303 interconnected with a bottom portion 304 and formed by a plurality of wire shaped elements. The bottom portion 304 includes a plurality of forms 305 for holding items in place on the middle washware rack 300. The middle washware rack 300 can include a handle 345. A rotatable stem holder 315 can be included on the side wall 303.

As noted above, the bottom washware rack 400 and the middle washware racks 300 are formed of wire shaped elements that are configured to have a basket shape. The wire shaped elements of the bottom and middle washware racks 400 and 300, respectively, may be formed of solid plastic, metal wire coated with plastic or rubber, or composite materials.

The third, top washware rack 200 is configured to hold cutlery and washware which is larger than cutlery such as, but not limited to, small dishes, bowls, cups, as well as cooking utensils. The third, top washware rack 200 is configured as a basket and includes front 201, rear (not shown), and opposing side walls 203 interconnected with a bottom portion 204 and formed by a plurality of wire shaped elements formed either entirely out of metal, or metal dipped in, for example, a Nylon powder. The third, top washware rack 200 can include a handle 245.

As shown in FIG. 1, the bottom or lower washware rack 400 (also referred to as a washware rack assembly) includes a plurality of adjustable glass support members extending across an interior of the lower washware rack (illustrated as adjustable wavy glass support wires as an exemplary embodiment) generally designated with the reference numeral 10 shown in an upper, use position according to an exemplary embodiment consistent with present disclosure. Of course, the adjustable wavy glass support wires 10 may also be used with the middle washware rack 300, or with an upper or third washware rack 200 that is disposed closer to the top of the dishwasher compartment. More specifically, with reference to FIGS. 1, 2, and 8A, each of the adjustable wavy glass support wires 10 includes a central wavy portion WP for supporting glasses and support extensions E at opposite ends for adjustably supporting the adjustable wavy glass support wire 10, as will be described in more detail below. As shown in FIG. 8A, the central wavy portion WP has a pattern of recesses R that are spaced so as to allow glasses having different diameters to load efficiently on condition that the adjustable wavy glass support wire 10 is in the use position. The adjustable glass support members 10 can be formed as wire shaped elements formed either entirely out of metal, metal wire coated with plastic or rubber (e.g., metal dipped in, for example, a Nylon powder), or may be formed of solid plastic, or composite materials.

Figure 8B:
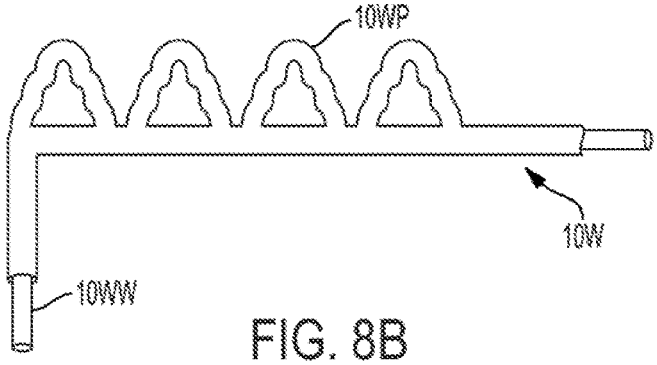
Figure 8C:
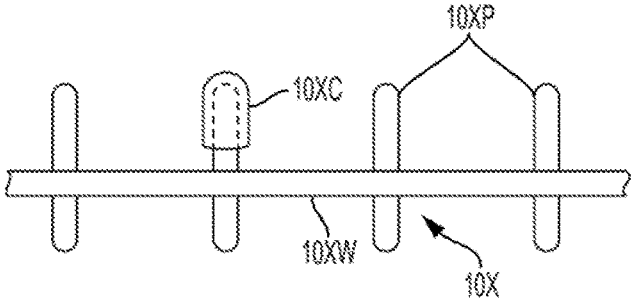
Figure 8D:
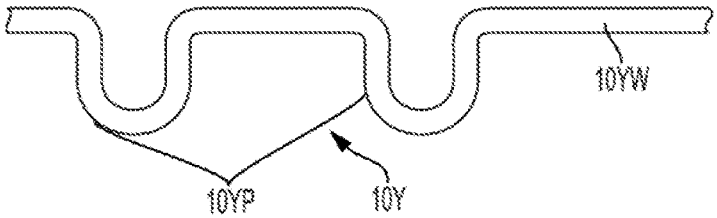
Figure 8E:
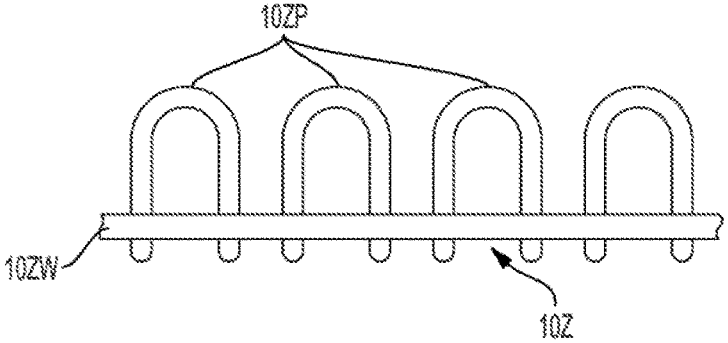

The adjustable glass support members 10 are not limited to an adjustable wavy glass support wire as shown in FIG. 8A, but can also have other shapes and still provide the same function. For example, FIGS. 8B, 8C, 8D, and 8E are views of various additional embodiments of one of the glass support members consistent with present disclosure. FIG. 8B shows a glass support member 10W having a wire portion 10WW and a plurality of loop projections 10WP that are covered with plastic or elastomeric material, so as to be formed of a composite of materials. FIG. 8C shows a glass support member 10X having a wire portion 10XW and a plurality of straight projections 10XP. The straight projections 10XP may have rubber tips or caps 10XC on their ends. FIG. 8D shows a glass support member 10Y with a wire portion 10YW having a different wireform shape with spaced apart projections 10YP. FIG. 8E shows a glass support member 10Z having a straight wire portion 10ZW and individual loop portions 10ZP mounted on the straight wire portion 10ZW.

Moreover, as shown in FIG. 1, each of the plurality of adjustable wavy glass support wires 10 may comprise, for example, four wavy glass support wires 10A, 10B, 10C, and 10D, although the number can be more or less. Each of the adjustable wavy glass support wires 10A-10D is supported with the extensions E at either end by support brackets generally designated with the reference numeral 20 disposed on the frame F. As shown in FIG. 1, the support brackets 20 (also referred to herein as "brackets") comprise support brackets 20A1 and 20A2 to adjustably support the right and left sides, respectively, of the wavy glass support wire 10A, support brackets 20B1 and 20B2 to adjustably support the right and left sides, respectively, of the wavy glass support wire 10B, support brackets 20C1 and 20C2 to adjustably support the right and left sides, respectively, of the wavy glass support wire 10C, and support brackets 20D1 and 20D2 to adjustably support the right and left sides, respectively, of the wavy glass support wire 10D. The structure and operation of the support brackets 20 are described in more detail below in connection with FIGS. 5A to 7B. Moreover, alternative embodiments of the support brackets 20 are described in detail below in connection with FIGS. 9A to 10E.

As shown in FIG. 1, an insert member 30 configured for holding glasses may be disposed on the bottom portion 404 of the frame F of the lower washware rack 400. The insert member 30 is described in detail below in connection with FIGS. 3A to 3C, while alternative embodiments of the insert member 30 are described in detail below in connection with FIGS. 4A to 4C. Of course, according to an exemplary embodiment consistent with present disclosure, the insert member 30 can be dispensed with and thus the glasses would rest directly on the bottom or lower washware rack (or washware rack assembly) 400 per se. Alternatively, the form of the insert member 30 can be constructed as unitary part of the bottom portion 404 of the lower washware rack 400 per se.

Figure 2:
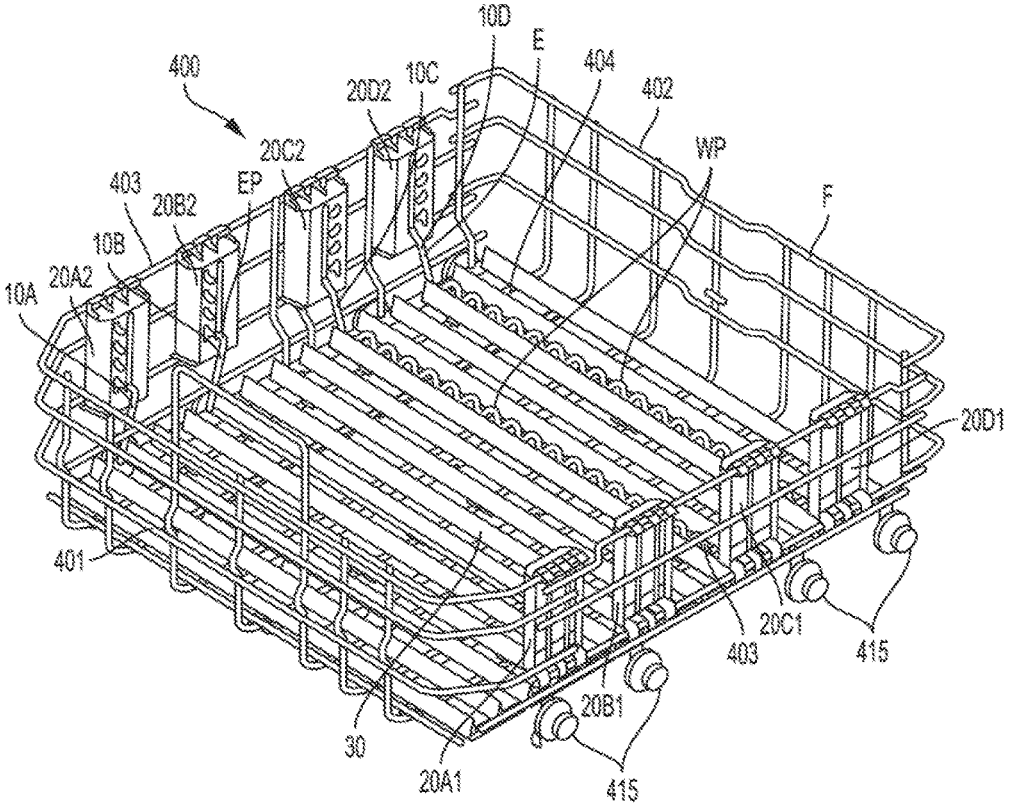
FIG. 2 is a top perspective view of the lower washware rack (or washware rack assembly) per se for the specialty dishwasher showing the adjustable glass support members (in this case, adjustable wavy glass support wires) in a lowered, non-use position according to an exemplary embodiment consistent with present disclosure.

FIG. 2 is a top perspective view of the bottom or lower washware rack (or washware rack assembly) 400 per se for the specialty dishwasher 100 showing the adjustable wavy glass support wires 10 in a lowered, non-use position according to an exemplary embodiment consistent with present disclosure. As noted above, the current lower washware racks are not well suited for holding glasses, and particularly stemware and barware type glasses. For example, the current lower washware racks have a plurality of vertically projecting tines that make it cumbersome and difficult to support stemware and barware type glasses. However, as can be seen in FIG. 2, the bottom or lower washware rack 400 is devoid of any vertically projecting tines, such that on condition that the adjustable wavy glass support wires 10 are in a non-use position where the adjustable wavy glass support wires 10 are swung down out of the way to the bottom portion 404 of the frame F, the bottom portion 404 of the frame F is configured to hold larger items including at least one of punch bowls, pots, pans, bowls, plates, cooking sheets, or the like.

Figure 3A:
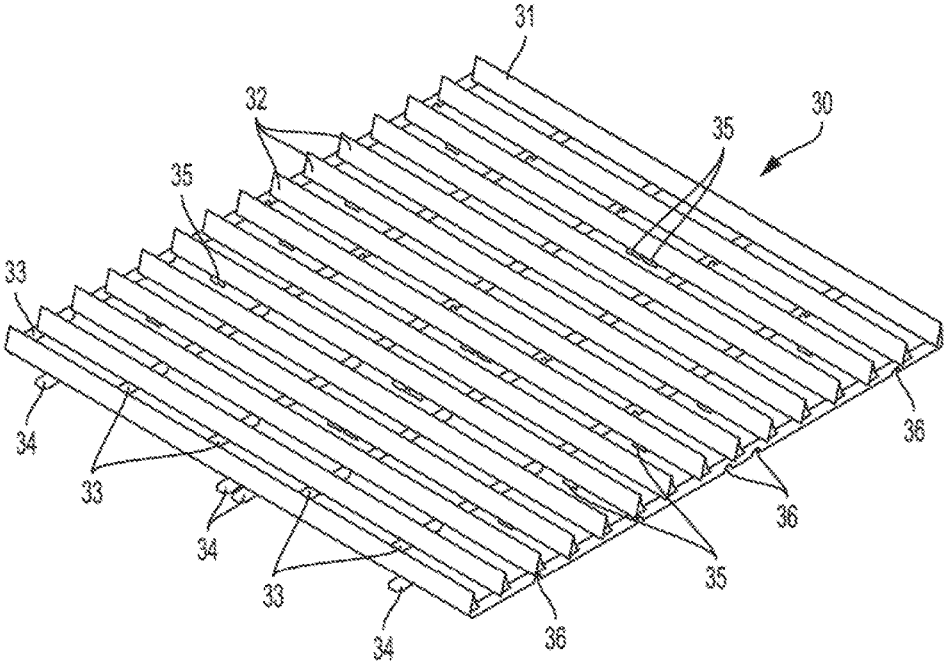
FIG. 3A is a top perspective view of an insert member configured for holding glasses and that is disposed on the bottom portion of the lower washware rack according to an exemplary embodiment consistent with present disclosure.

As best seen in FIG. 3A, the insert member 30 comprises a grill 31 configured to hold a plurality of glasses preferably, but not necessarily, at an angle to prevent water from pooling in the base of the glass, with the open rim of the glass resting on the grill 31 and the base or stem of the glass, depending on the type of glass, resting on the central wavy portion WP of the adjustable wavy glass support wire 10. Also, the number of contact points required to hold the glasses is minimized to prevent water spots. The grill 31 comprises a plurality of plate members 32 mounted on frame of spaced, substantially perpendicular crossbars 33. As shown in FIG. 3A, the crossbars 33 may each include a plurality of recesses or grooves 36 for being fitted over the wires forming the bottom portion 404 of the frame F. With reference to FIG. 2, when each of the adjustable wavy glass support wires 10 is in a non-use position where the adjustable wavy glass support wire 10 is swung down out of the way to the bottom portion 404 of the frame F, the adjustable wavy glass support wire 10 is positioned such that the central wavy portions WP are disposed between adjacent plate members 32 of the insert member 30 (see, e.g., the adjustable wavy glass support wires 10C and 10D that are visible in FIG. 2).

Figure 3B:
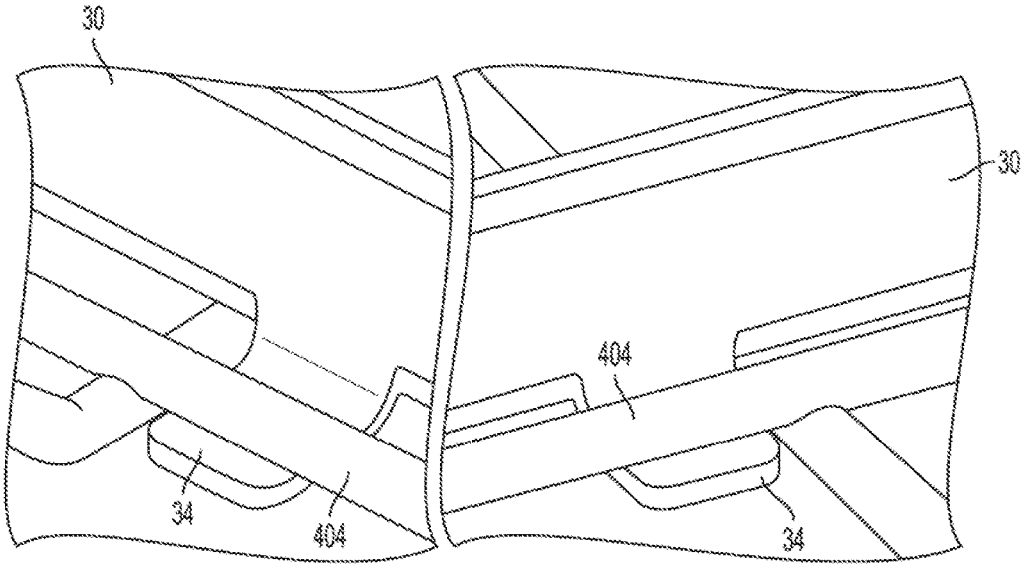
FIGS. 3B and 3C are enlarged views that show how the insert member is retained in the lower washware rack according to an exemplary embodiment consistent with present disclosure.
Figure 3C:
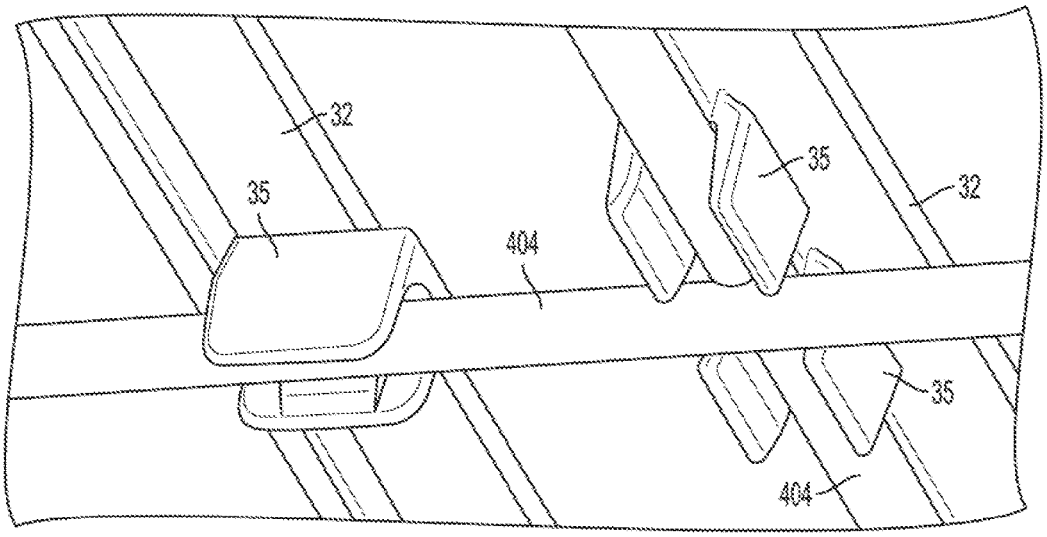

With reference to FIGS. 3A to 3C, the insert member 30 further comprises a plurality of tabs 34 and snaps 35 to retain the insert member 30 in the bottom portion 404 of the frame F of the lower washware rack 400. FIGS. 3B and 3C are enlarged views that show how the insert member 30 is retained in the lower washware rack 400 according to an exemplary embodiment consistent with present disclosure. In particular, as shown in FIG. 3B, the tabs 34 are disposed on a lower portion of the outer periphery of the insert member 30 and are fitted under the adjacent wire member of the bottom portion 404 of the frame F. As shown in FIG. 3C, the snaps 35 are disposed throughout the bottom of the insert member 30 on, for example, the bottom portion of the plate members 32 of the grill 31. The snaps 35 are configured to snap over the adjacent wire member of the bottom portion 404 of the frame F. As noted above, the recesses or grooves 36 may also be fitted over the wires forming the bottom portion 404 of the frame F.

FIGS. 4A, 4B, and 4C are top perspective views of various alternative embodiments of the insert member 30 that is disposed on the bottom portion 404 of the bottom or lower washware rack 400 according to an exemplary embodiment consistent with present disclosure. More specifically, FIGS. 4A, 4B, and 4C show various alternative embodiments of the insert member 30 where the grill 31 comprises a plurality of angled stepped portions on which the open rims of various sized glasses can rest. In FIG. 4A, the insert member 30' comprises a grill 31' having a plurality of stepped portions ST' each with a gentle slope. FIG. 4B shows an insert member 30" comprising a grill 31" having a plurality of stepped portions ST" each with a steeper slope and the flat areas between the steps are removed thus allowing larger mouthed glasses, as compared to the embodiment of FIG. 4A. FIG. 4C shows an insert member 30'" comprising a grill 31'" having a plurality of stepped portions ST'" with a variation on the shape of the various crossbars. In particular, FIG. 4C shows a surface shaped like pyramids where one glass would rest on each pyramid. This allows more stability for each glass with few contact points, but would have less flexibility to put additional smaller diameter glasses in a single load.

The structure and operation in connection with the adjustment of the adjustable wavy support wire 10 in the corresponding the support brackets 20 will now be described in connection with FIGS. 5A through 5F.

In particular, as shown in FIG. 5A, two right, rear support brackets 20C1 and 20D1 are shown supporting respective adjustable wavy wire supports 10C and 10D. More specifically, the extensions E which extend from the central wavy portions WP and extend into a respective elongated, substantially vertical slot formed in the support bracket 20. For example, support bracket 20C1 has an elongated, substantially vertical slot 21 for an end portion of the adjustable wavy glass support wire 10C to move up and down in, and a plurality of substantially vertically spaced stepped portions 22 arranged alongside of the elongated substantially vertical slot 21 for receiving an end of the adjustable wavy glass support wire 10C to adjust the height of the adjustable wavy glass support wire 10C. Each of the stepped portions 22 comprises a curved opening 23.

The end portion EP of each adjustable wavy support wire 10 is configured by bending the extension E outwardly approximately 90 degrees in a direction toward the outside of the side wall 403 of the frame F such that a substantially straight portion passes through the corresponding elongated, substantially vertical slot 21 (see FIG. 2 for end portion EP) and then bends back around in a hook-shaped portion H away from the central wavy portion WP and then toward an inside of the frame F (see FIGS. 5B to 5F). During height adjustment of the adjustable wavy support wire 10, the end of the hook-shaped portion H is configured to pass into a corresponding curved opening 23 and rest on a stepped portion 22, as will be described in detail below with respect to FIGS. 5B through 5F.

The adjustment of the adjustable wavy support wire 10 will now be described with respect to one end portion EP and the corresponding support bracket 20, with the understanding that the same action is taking place on the opposite end of the adjustable wavy support wire 10. First, note that FIG. 5B shows the bracket 20 as viewed from outside the side wall 403 of the wire frame F, with the left side including the side wall 403 and the right side removing the side wall 403 for ease of understanding. Starting with FIG. 5B, the adjustable wavy support wire 10 is shown in a non-use position such that the central wavy portion WP is disposed or stored between two adjacent plate members 32 of the grill 31 of the insert member 30. One end of the central wavy portion WP can have a stopper member SM with one end configured to rest on one of the crossbars 33, for example, of the grill 31 of the insert member 30. The substantially straight portion of the end portion EP passes through the corresponding elongated, substantially vertical slot 21 and rests on the bottom portion 21' of the elongated slot 21. The end of the hook-shaped portion H is disposed in a corresponding resting area 24. As shown in FIG. 5B, the support bracket 20 includes snap portions 25 at the bottom to snap over one of the wires forming the side wall 403 of the frame F, and snap members 26 at the top to snap over another of the wires forming the side wall 403 of the frame F.

Figure 5C:
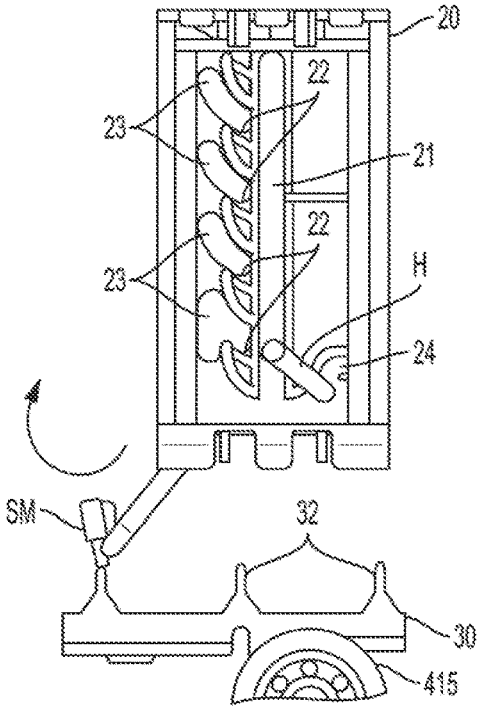

Next, with reference to FIG. 5C, the user begins to position the adjustable wavy support wire 10 from the non-use position as shown in FIG. 5B to the use position by rotating the adjustable wavy support wire 10 about a pivot point at the bottom of slot 21 in a clockwise direction in the figure such that the end of the hook-shaped portion H is moved out of the corresponding resting area 24. Moreover after the end of the hook-shaped portion H has rotated out over the outer ends of the curved opening 23, the end portion EP begins moving up in the corresponding elongated, substantially vertical slot 21 of the support bracket 20 as the user lifts the adjustable wavy support wire 10.

Figure 5D:
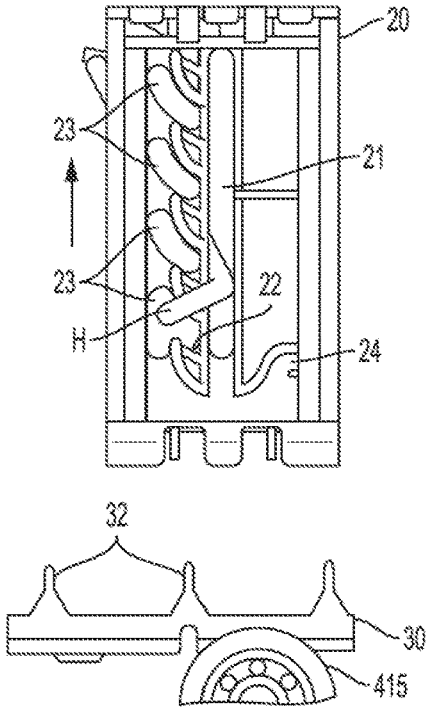

As shown in FIG. 5D, the end portion EP has moved up in height enough in the corresponding elongated, substantially vertical slot 21 and the end of the hook-shaped portion H has rotated into the area of the lowest curved opening 23 where the lowest stepped portion 22 is located. If the user wished to position the adjustable wavy support wire 10 in the lowest height setting in a use position, the end of the hook-shaped portion H is simply rotated counterclockwise to the end of the lowest curved opening 23 so as to rest on the lowest stepped portion 22. This same motion is repeated to set the adjustable wavy support wire 10 at each height.

Figure 5E:
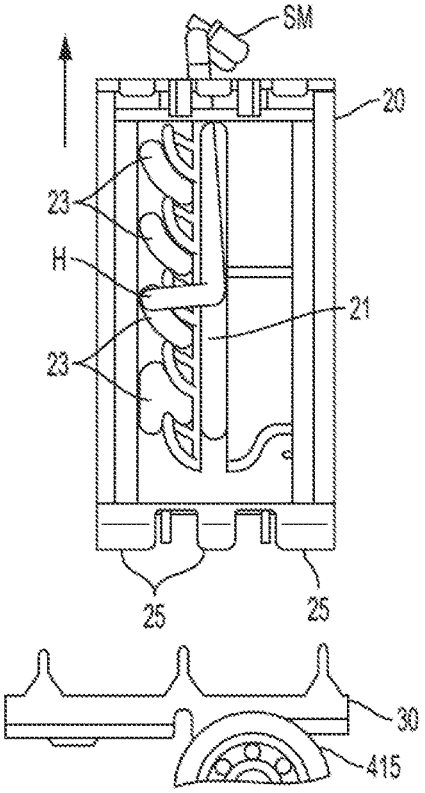
Figure 5F:
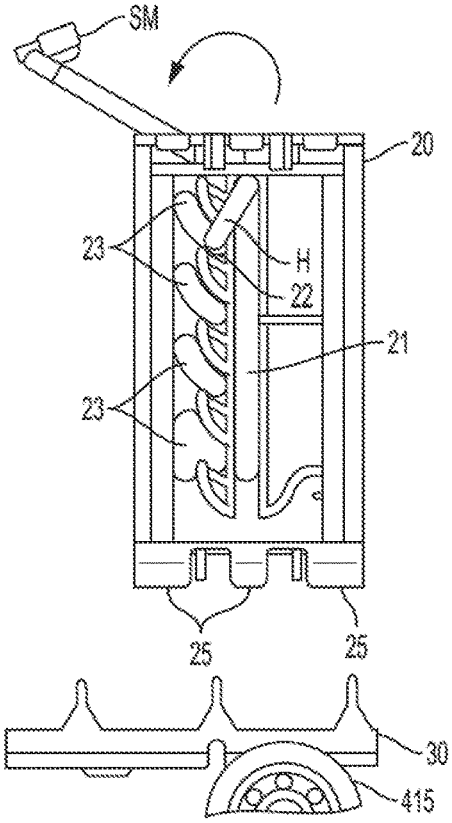

On the other hand, should the user want to raise the adjustable wavy support wire 10 to a higher position, as shown in FIG. 5E, the user continues to raise the end portion EP up in height in the corresponding elongated, substantially vertical slot 21 while the end of the hook-shaped portion H remains out over the outer ends of the curved openings 23. When the end portion EP is raised up in height to the top end of the corresponding elongated, substantially vertical slot 21, the user can then rotate the end of the hook-shaped portion H counterclockwise to the end of the highest curved opening 23 so as to rest on the highest stepped portion 22, as shown in FIG. 5F.

FIGS. 6A, 6B, and 6C are partial, top perspective views showing wine glasses WG, champagne glasses CG, and brandy glasses BG, respectively, being supported by the adjustable wavy glass support wires 10 in the lower washware rack 400 according to an exemplary embodiment consistent with present disclosure. Further, FIGS. 7A and 7B are side elevation views of the lower washware rack 400 with various types of glasses including standard glasses G being supported by the adjustable wavy glass support wires 10 according to an exemplary embodiment consistent with present disclosure. Note that the adjustable wavy glass support wire 10', which is the second one from the left or front of the lower washware rack 400, is shown adjusted to a lower height than the other adjustable wavy glass support wires 10.

Figure 9A:
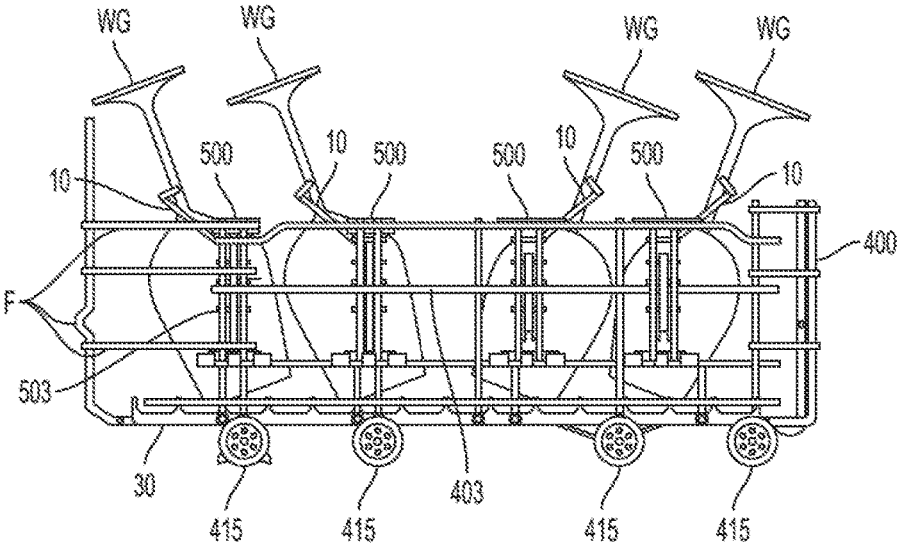
Figure 9B:
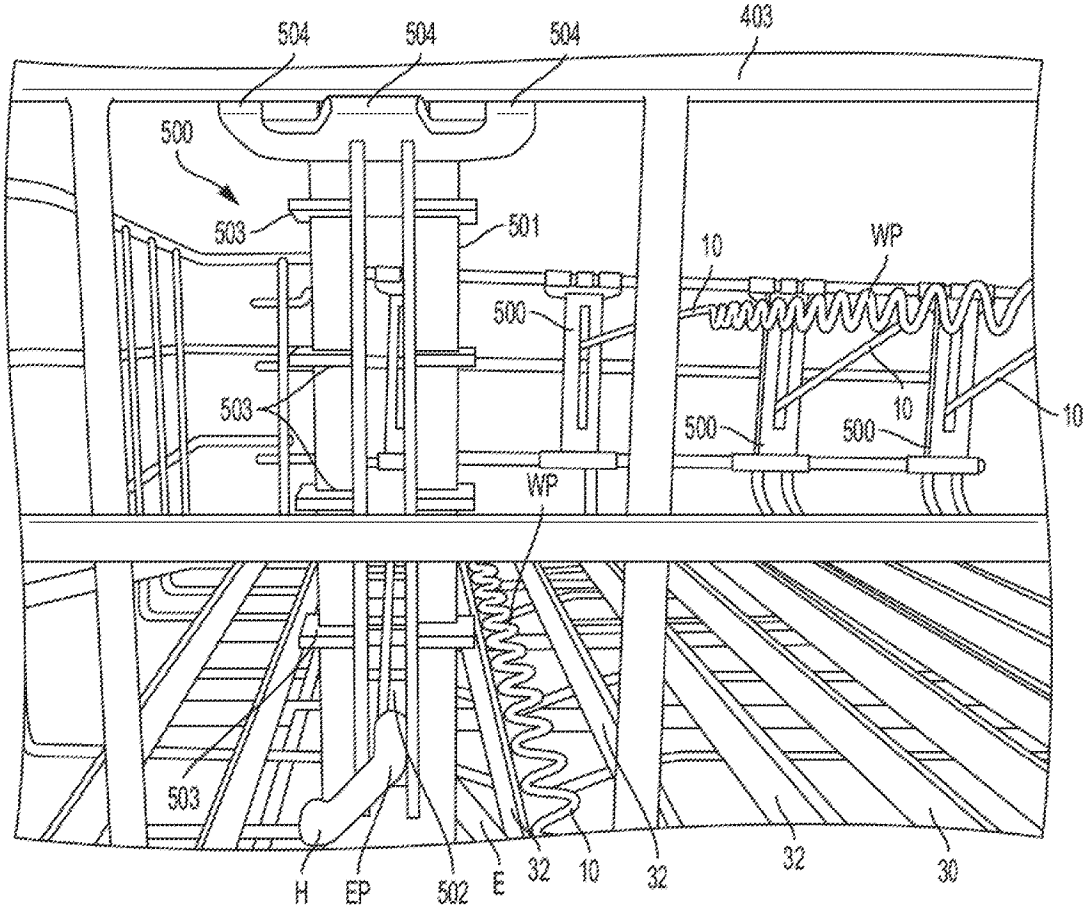

Alternative embodiments of the support brackets 20 will now be described in detail below in connection with FIGS. 9A to 10E. FIGS. 9A, 9B, 9C, and 9D are various views of a further embodiment of the support brackets for supporting the wavy glass support wires in the lower washware basket 400 according to an exemplary embodiment consistent with present disclosure. Like elements are designated by like reference numerals. In particular, as shown in FIG. 9A, similar to support brackets 20, each of the adjustable wavy glass support wires 10 is supported with the extensions E at either end by support brackets 500 disposed on the frame F of the lower washware basket 400. As best seen in FIG. 9B, each bracket 500 comprises a body 501 having an elongated, substantially vertical slot 502 passing therethrough, and a plurality of stepped portions in the form of substantially horizontal plate-shaped members 503 (for example, four platforms) at various heights adjacent to the elongated slot 502.

Starting with FIG. 9B, the adjustable wavy support wire 10 is shown in a non-use position such that the central wavy portion WP is disposed or stored between two adjacent plate members 32 of the insert member 30. The substantially straight portion of the end portion EP passes through the corresponding elongated, substantially vertical slot 502 and rests on the bottom portion of the elongated slot 502. The end of the hook-shaped portion H simply rests to one side of the body 501 near the bottom thereof. The support bracket 500 includes snap portions 504, 504' at the top and bottom, respectively, to snap over the wires forming the side wall 403 of the frame F similar to the support bracket 20 as described above (the bottom snap portions 504' are visible in FIG. 9D).

Figure 9C:
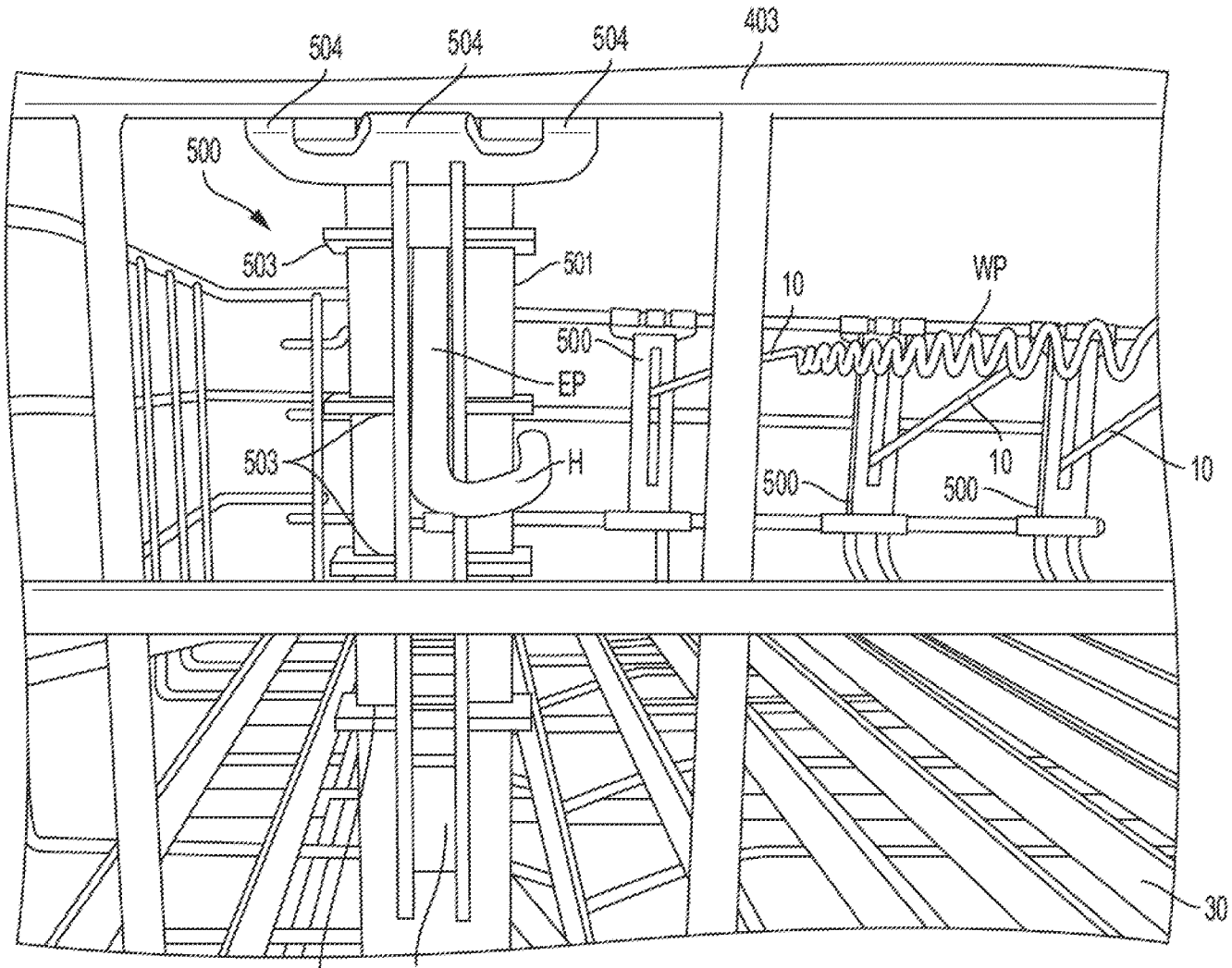
Figure 9D:
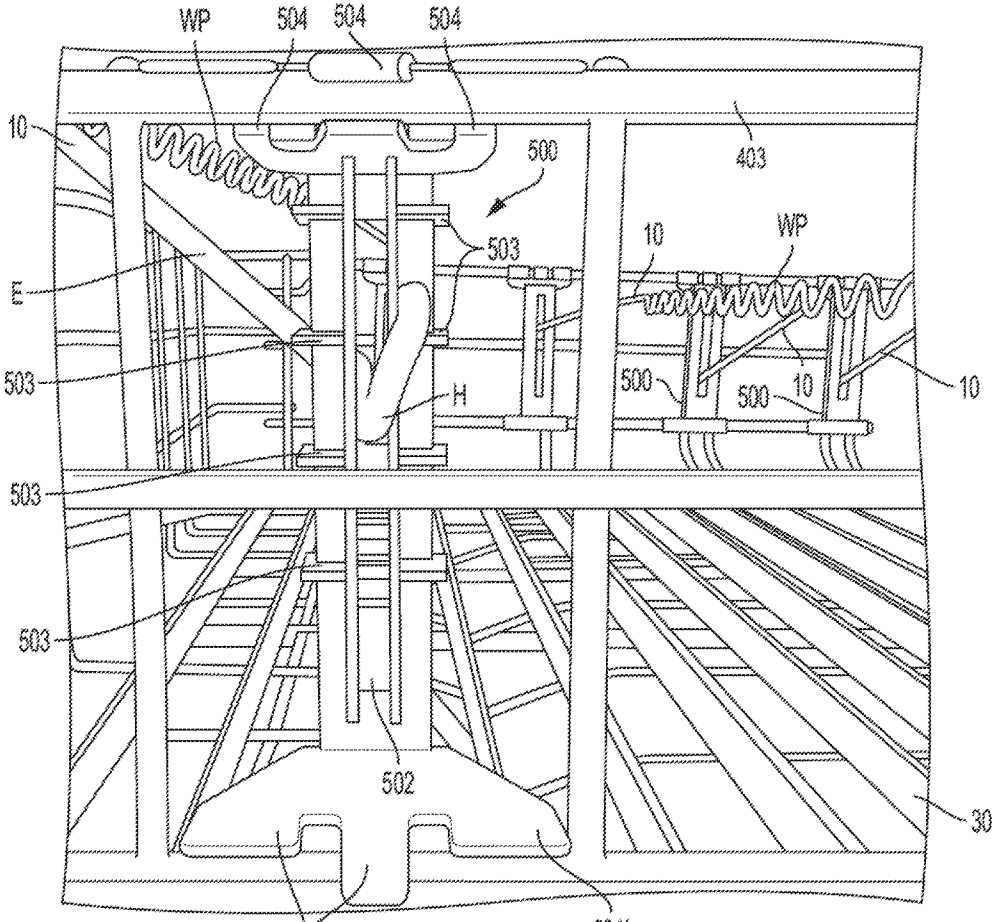

With reference to FIGS. 9C and 9D, in order to place the adjustable wavy support wire 10 in a use position and adjust the height thereof, the adjustable wavy support wire 10 is rotated counterclockwise in FIGS. 9C and 9D such that the end of the hook-shaped portion H passes under the elongated slot 502. Then, the user continues to raise the end portion EP up in height in the corresponding elongated, substantially vertical slot 502 while the end of the hook-shaped portion H remains out over the outer ends of the substantially horizontal plate-shaped members 503, as shown in FIG. 9C. When the end portion EP of the adjustable wavy support wire 10 is raised up to a desired height in the elongated vertical slot 502, the user can then further rotate the end of the hook-shaped portion H counterclockwise so as to rest on top of the desired horizontal plate-shaped member 503 (in this case the second one from the top), as shown in FIG. 9D.

FIG. 10A is a side elevation view of a still further embodiment of the support brackets for supporting the adjustable wavy glass support wires 10 in the lower washware basket 400 according to an exemplary embodiment consistent with present disclosure. FIGS. 10B, 10C, 10D, and 10E are enlarged views of the support bracket of FIG. 10A for supporting the adjustable wavy glass support wires showing the adjustable wavy glass supporting wire starting in a lowered, non-use position and then being adjusted upwardly to a desired position. Like elements are designated by like reference numerals. In particular, as shown in FIG. 10A, similar to support brackets 20, each of the adjustable wavy glass support wires 10 is supported with the extensions E at either end by support brackets 600 disposed on the frame F of the lower washware basket 400. As shown in FIG. 10A, various glasses are shown, including a wine glass WG, a champagne glass CG, a brandy glass BG, and a stemless wine glass SWG, supported or disposed in the lower washware rack 400.

As best seen in FIGS. 10B and 10C, each bracket 600 comprises a body 601 having an elongated, substantially vertical slot 602 passing therethrough, and a plurality of stepped portions in the form of saw-toothed shaped members 603 (for example, twelve stepped portions) at various heights adjacent to the elongated slot 602.

Starting with FIGS. 10B and 10C, the adjustable wavy support wire 10 is shown in a non-use position such that the central wavy portion WP is disposed or stored within the insert member IM. The substantially straight portion of the end portion EP passes through the elongated, substantially vertical slot 602 and rests on the bottom portion of the elongated slot 602. The end or tip H' of the adjustable wavy support wire 10 has a somewhat different shape than in the previous embodiments, with the end H' extending in a plane that is parallel to a vertical plane of the side wall 403 rather than bending back and facing the inside of the frame F. As shown in FIG. 10C, the end H' simply rests facing substantially upwardly near the bottom of elongated vertical slot 602. The support bracket 600 includes snap portions 604, 604' at the top and bottom, respectively, to snap over single vertical wire 605 or a pair of spaced apart vertical wires 605 formed as part of the side wall 403 of the frame F.

With reference to FIGS. 10D and 10E, in order to place the adjustable wavy support wire 10 in a use position and adjust the height thereof, the adjustable wavy support wire 10 is rotated (clockwise in FIGS. 10C and 10E) such that the end H' of the adjustable wavy support wire 10 rotates around so as to face generally downward. Then, as the user continues to raise the end portion EP up in height in the corresponding elongated, substantially vertical slot 602 while the end H' remains just inside of the saw-toothed shaped members 603 until the end portion EP of the adjustable wavy support wire 10 is raised up to a desired height in the elongated vertical slot 602. At that time, the user can then rotate the end H' counterclockwise slightly so as to rest the end or tip H' in a desired one of the saw-toothed shaped members 603, as shown in FIG. 10E.

FIG. 11A is a fragmentary perspective view from inside the lower washware rack 400 and FIGS. 11B and 11C are side elevation views from outside the lower washware rack 400 of a still further embodiment of the support brackets for supporting the adjustable wavy glass support wires 10 in the lower washware rack 400 according to an exemplary embodiment consistent with present disclosure. With reference to FIG. 11A, each of the support brackets 700 comprises a body 701 having a generally J-shaped elongated slot 702 passing therethrough, and a plurality of slots 703 (for example, three slots) at various heights adjacent to the generally J-shaped elongated slot 702. The slots 703 are visible from inside the lower washware rack for user convenience and are configured to permit the corresponding adjustable wavy glass support wire 10 to be locked in place such as with a reduced width opening portion of the slot 703. The left hand side of FIG. 11A shows an adjustable wavy glass support wire 10 in an uppermost position and the right hand side of FIG. 11A shows another adjustable wavy glass support wire 10 in the lowermost position, such that the adjustable wavy glass support wire 10 is in a non-use position where the adjustable wavy glass support wire 10 is swung down out of the way to the bottom portion 404 of the frame F. The support bracket 700 includes snap portions 704, 704' at the top and bottom, respectively, to snap over the side wall 403 and a pair of spaced apart vertical wires 705 formed as part of the side wall 403 of the frame F.

Starting with FIG. 11B and keeping in mind that the following action is taking place in the support brackets 700 on opposite sides of the frame F which support a corresponding adjustable wavy support wire 10, the adjustable wavy support wire 10 is shown in a non-use position such that the central wavy portion WP is disposed or stored within the insert member 30. In this position, the adjustable wavy glass support wire 10 snaps into position in a parking region 706 formed by a projecting part 706' at the end portion of the generally J-shaped elongated slot 702. The projecting part 706' forms a reduced width opening portion of the parking region 706. In order to raise the adjustable wavy support wire 10, the adjustable wavy support wire 10 is rotated counterclockwise in FIGS. 11B and 11C such that the end H" pivots and the end portion EP moves through the curved portion at the lower part of the generally J-shaped elongated slot 702 and is raised and pivoted into the first or lowest slot 703 (see FIG. 11C). In order to further raise the adjustable wavy support wire 10, the adjustable wavy support wire 10 is rotated clockwise slightly to back the end portion EP out of the lowest slot 703 and then the adjustable wavy support wire 10 is raised vertically by the user in the generally J-shaped elongated slot 702. At the same time, the end H" moves up vertically in a parallel groove 707 formed in the body 701. Then, when the end portion EP reaches the desired slot 703 at the next height, the user rotates the adjustable wavy support wire 10 slightly counterclockwise to snap the end portion into the desire slot 703.

Of course, varies features of each of the embodiments can be used together with the other embodiments wherever appropriate.

The present invention has substantial opportunity for variation without departing from the spirit or scope of the present invention. For example, while the adjustable glass support members are described for use preferably, but not necessarily, with a lower washware rack, the adjustable glass support members may also be used with a middle washware rack, or with an upper or third washware rack that is disposed closer to the top of the dishwasher compartment.

Those skilled in the art will recognize improvements and modifications to the exemplary embodiments of the present invention. All such improvements and modifications are considered within the scope of the concepts disclosed herein and the claims that follow.

What is claimed is:

1. A dishwasher, comprising:

a dishwashing compartment having a loading opening;

a door configured to close the loading opening; and at least one washware rack configured for movement out of and into the dishwashing compartment, wherein the at least one washware rack comprises:

a frame having a bottom portion and a side wall portion;

an insert member which is disposed in the bottom portion of the frame, the insert member being configured as a grill comprising a plurality of spaced apart plate members; and at least one adjustable glass support member extending entirely across an interior of the at least one washware rack from side to side in a width direction that is perpendicular to the movement of the at least one washware rack out of and into the dishwashing compartment and disposed on the frame via brackets, wherein the brackets are disposed on opposing side walls of the frame and are configured to allow height adjustment of the at least one adjustable glass support member, and wherein the at least one adjustable glass support member includes a glass support portion and is adjustable between a use position where glasses can rest against the at least one adjustable glass support member, and a non-use position where the at least one adjustable glass support member is swung down out of the way to the bottom portion of the frame, so that the glass support portion is disposed between adjacent plate members of the grill and below a top portion of the adjacent plate members.

2. The dishwasher according to claim 1, wherein the at least one washware rack comprises a lower washware rack.

3. The dishwasher according to claim 2, wherein the lower washware rack is devoid of any vertical tines extending from the bottom portion of the frame.

4. The dishwasher according to claim 1, wherein the glass support portion of the at least one adjustable glass support member comprises an adjustable wavy glass support wire.

5. The dishwasher according to claim 4, wherein the adjustable wavy glass support wire has a pattern of recesses that are spaced so as to allow glasses having different diameters to load efficiently on condition that the at least one adjustable wavy glass support wire is in the use position.

6. The dishwasher according to claim 4, wherein on condition that the adjustable wavy glass support wire is in a non-use position, the bottom portion of the frame is configured to hold larger items including at least one of punch bowls, pots, pans, bowls, plates, or cooking sheets.

7. The dishwasher according to claim 1, wherein the at least one adjustable glass support member comprises a plurality of adjustable wavy glass support wires.

8. The dishwasher according to claim 1, wherein each bracket includes an elongated substantially vertical slot for an end portion of the at least one adjustable glass support member to move up and down in, and a plurality of substantially vertically spaced stepped portions arranged alongside of the elongated substantially vertical slot for receiving an end of the at least one adjustable glass support member to adjust the height of the at least one adjustable glass support member.

9. The dishwasher according to claim 8, wherein each of the stepped portions comprises a curved opening.

10. The dishwasher according to claim 8, wherein each of the stepped portions comprises a substantially horizontal plate-shaped member.

11. The dishwasher according to claim 8, wherein each of the stepped portions comprises a saw-toothed shaped member.

12. The dishwasher according to claim 1, wherein each bracket includes a generally J-shaped elongated slot for an end portion of the at least one adjustable glass support member to move in, and a plurality of substantially vertically spaced slots arranged adjacent to the generally J-shaped elongated slot for receiving the end portion of the at least one adjustable glass support member to adjust the height of the at least one adjustable glass support member.

13. The dishwasher according to claim 1, wherein the grill is configured to hold a plurality of glasses at an angle.

14. The dishwasher according to claim 13, wherein the plurality of spaced apart plate members are mounted on a grill frame of spaced apart, substantially perpendicular crossbars with respect to the plurality of spaced apart plate members.

15. The dishwasher according to claim 13, wherein the grill comprises a plurality of angled stepped portions.

16. The dishwasher according to claim 1, wherein the insert member comprises a plurality of tabs and snaps to retain the insert member in the bottom portion of the frame of the at least one washware rack.

17. A washware rack assembly for a dishwasher configured to receive washware including glassware therein and to be inserted into and removed from a dishwashing compartment of the dishwasher, the washware rack assembly comprising:

a frame having a bottom portion and a side wall portion;

an insert member which is disposed in the bottom portion of the frame, the insert member being configured as a grill comprising a plurality of spaced apart plate members;

at least one adjustable glass support member extending entirely across an interior of the washware rack assembly from side to side in a width direction that is perpendicular to a movement of the washware rack assembly out of and into the dishwashing compartment and disposed on the frame via brackets, wherein the brackets are disposed on opposing side walls of the frame and are configured to allow height adjustment of the at least one adjustable glass support member, and wherein the at least one adjustable glass support member includes a glass support portion and is adjustable between a use position where glasses can rest against the at least one adjustable glass support member, and a non-use position where the at least one adjustable glass support member is swung down out of the way to the bottom portion of the frame, so that the glass support portion is disposed between adjacent plate members of the grill and below a top portion of the adjacent plate members.

18. The washware rack assembly according to claim 17, wherein the washware rack assembly comprises a lower washware rack.

19. The washware rack assembly according to claim 18, wherein the lower washware rack is devoid of any vertical tines extending from the bottom portion of the frame.

20. The washware rack assembly according to claim 17, wherein the glass support portion of the at least one adjustable glass support member comprises an adjustable wavy glass support wire.

21. A dishwasher, comprising:

a dishwashing compartment having a loading opening;

a door configured to close the loading opening; and at least one washware rack configured for movement out of and into the dishwashing compartment, wherein the at least one washware rack comprises:

a frame having a bottom portion and a side wall portion; an insert member which is disposed in the bottom portion of the frame; and at least one height adjustable wavy glass support wire extending entirely across an interior of the at least one washware rack from side to side in a width direction that is perpendicular to the movement of the at least one washware rack out of and into the dishwashing compartment and disposed on the frame via brackets, wherein the insert member comprises a grill configured to hold a plurality of glasses at an angle, wherein the grill comprises a plurality of plate members extending in the width direction and mounted on a grill frame of spaced apart, substantially perpendicular crossbars with respect to the plurality of plate members, and wherein the at least one adjustable glass support member includes a glass support portion and is adjustable between a use position where glasses can rest against the at least one adjustable glass support member, and a non-use position where the at least one adjustable glass support member is swung down out of the way to the bottom portion of the frame, so that the glass support portion is disposed between adjacent plate members and below a top portion of the adjacent plate members.

22. A dishwasher, comprising:

a dishwashing compartment having a loading opening;

a door configured to close the loading opening; and at least one washware rack configured for movement out of and into the dishwashing compartment, wherein the at least one washware rack comprises:

a frame having a bottom portion and a side wall portion;

an insert member which is disposed in the bottom portion of the frame; and at least one adjustable glass support member extending entirely across an interior of the at least one washware rack from side to side in a width direction that is perpendicular to the movement of the at least one washware rack out of and into the dishwashing compartment and disposed on the frame via brackets, wherein the brackets are disposed on opposing side walls of the frame, wherein each bracket includes a generally J-shaped elongated slot having an upper substantially vertical portion and a lower curved portion for an end portion of the at least one adjustable glass support member to move in, and a plurality of substantially vertically spaced slots arranged adjacent to the upper substantially vertical portion of the generally J-shaped elongated slot for receiving the end portion of the at least one adjustable glass support member to adjust the height of the at least one adjustable glass support member, and wherein the at least one adjustable glass support member includes a glass support portion and is adjustable between a use position where glasses can rest against the at least one adjustable glass support member, and a non-use position where the at least one adjustable glass support member is swung down out of the way to the bottom portion of the frame, so that the glass support portion is disposed below a top portion of the insert member.

23. The dishwasher of claim 22, wherein the lower curved portion of the generally J-shaped elongated slot extends in a common direction to that of each of the plurality of substantially vertically spaced slots with respect to the upper substantially vertical portion of the generally J-shaped elongated slot.

* * * * *